US009878362B2

(12) United States Patent
Yoshida

(10) Patent No.: US 9,878,362 B2
(45) Date of Patent: Jan. 30, 2018

(54) PRESS-FORMING TOOL AND METHOD FOR MANUFACTURING PRESS-FORMED PRODUCT

(71) Applicant: NIPPON STEEL & SUMITOMO METAL CORPORATION, Tokyo (JP)

(72) Inventor: Tohru Yoshida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 240 days.

(21) Appl. No.: 14/418,049

(22) PCT Filed: Dec. 19, 2012

(86) PCT No.: PCT/JP2012/082907
§ 371 (c)(1),
(2) Date: Jan. 28, 2015

(87) PCT Pub. No.: WO2014/097421
PCT Pub. Date: Jun. 26, 2014

(65) Prior Publication Data

US 2015/0298197 A1 Oct. 22, 2015

(51) Int. Cl.
*B21D 24/12* (2006.01)
*B21D 22/22* (2006.01)
(Continued)

(52) U.S. Cl.
CPC ..... *B21D 24/12* (2013.01); *B21D 5/01* (2013.01); *B21D 22/22* (2013.01); *B21D 22/26* (2013.01);
(Continued)

(58) Field of Classification Search
CPC ..... B21D 24/06; B21D 24/02; B21D 24/12; B21D 24/04; B21D 22/02; B21D 22/20;
(Continued)

(56) References Cited

U.S. PATENT DOCUMENTS

2002/0095968 A1* 7/2002 Matsunaga ..... B21D 22/02 72/350
2011/0083487 A1 4/2011 Ota et al.

FOREIGN PATENT DOCUMENTS

CN 102039690 A 5/2011
EP 0614711 * 9/1994
(Continued)

OTHER PUBLICATIONS

Machine Translation of EP-0614711.*
(Continued)

*Primary Examiner* — R. K. Arundale
*Assistant Examiner* — Mohammad Yusuf
(74) *Attorney, Agent, or Firm* — Birch, Stewart, Kolasch & Birch, LLP

(57) ABSTRACT

A press-forming tool comprising: a punch including a punch portion and a plate portion transferring shape to a blank material; a die paired with the punch and opposes the punch portion; a wrinkle suppression mold including a first surface opposing the plate portion and comes into contact with the plate portion at a press-forming ending point, a second surface opposing the die and holds the blank material along with the die, and a third surface continued between the first and second surface and opposes the punch portion, and disposed between the third surface and the punch portion via a gap; a pressure receiving portion including a groove portion on the first surface of the wrinkle suppression mold; and a wrinkle suppression force increasing portion disposed on a surface opposing the first surface of the plate portion, protrudes toward the pressure receiving portion, and generates a reaction force opposed to a pressing direction when pressed in the pressing direction in end-phase of a press-forming.

12 Claims, 22 Drawing Sheets

(51) Int. Cl.

| | |
|---|---|
| ***B21D 22/26*** | (2006.01) |
| ***B21J 13/02*** | (2006.01) |
| ***B21D 5/01*** | (2006.01) |
| ***B21J 5/00*** | (2006.01) |
| *B21D 24/04* | (2006.01) |
| *B21D 53/88* | (2006.01) |

(52) U.S. Cl.
CPC ..... *B21J 5/00* (2013.01); *B21J 13/02* (2013.01); *B21D 24/04* (2013.01); *B21D 53/88* (2013.01)

(58) Field of Classification Search
CPC ..... B21D 5/01; B21D 22/26; B21D 53/88; B21D 22/22; B21J 13/02; B21J 5/00
See application file for complete search history.

(56) References Cited

FOREIGN PATENT DOCUMENTS

| | | | |
|---|---|---|---|
| JP | 60-191620 | A | 9/1985 |
| JP | 11-216527 | A | 8/1999 |
| JP | 2002-321013 | A | 11/2002 |
| JP | 2003-94119 | A | 4/2003 |
| JP | 2004-344925 | A | 12/2004 |
| JP | 2009-255116 | A | 11/2009 |
| JP | 2009-255117 | A | 11/2009 |
| JP | 2011-235356 | A | 11/2011 |
| JP | 2013-103240 | A | 5/2013 |
| RU | 2 057 606 | C1 | 4/1996 |
| SU | 269137 | A1 | 4/1970 |
| SU | 759177 | A1 | 8/1980 |

OTHER PUBLICATIONS

Machine Translation of JP-2011-235356.*
International Search Report, dated Apr. 2, 2013, issued in PCT/JP2012/082907.
Office Action in Japanese Application No. 2011-247566 dated Sep. 10, 2013.
Written Opinion of the International Searching Authority, dated Apr. 2, 2013, issued in PCT/JP2012/082907.
Japanese Office Action, dated Mar. 3, 2015, for Japanese Application No. 2014-552812, along with an English translation.
Russian Office Action and Search Report, dated May 18, 2016, for counterpart Russian Application No. 2015106722, with an English translation of the Office Action.
Chinese Office Action and Search Report for Chinese Application No. 201280074661.8, dated Jul. 31, 2015, with an English translation of the Search Report only.
Taiwanese Office Action and Search Report for Taiwanese Application No. 101149543, dated Jun. 22, 2015, with an English translation of the Search Report only.

* cited by examiner $\Delta W_h = W_h' - W_h$ $\Delta W_c = W_c' - W_c$

PRESS-FORMING TOOL AND METHOD FOR MANUFACTURING PRESS-FORMED PRODUCT

TECHNICAL FIELD OF THE INVENTION

The present invention relates to a press-forming tool for a metal plate, and a method for manufacturing a press-formed product which is press-formed using the press-forming tool. Particularly, the present invention relates to a press-forming tool and a method for manufacturing a press-formed product for securing improved shape freezing properties by decreasing springback which is generated after the press forming is performed.

RELATED ART

It is possible to form members having various shapes by performing press forming using a metal plate such as a steel sheet or aluminum alloy plate. Accordingly, many press-formed products are used in members for an automobile and the like.

In the press-formed product, there is a problem relating to a dimension accuracy defect (a shape freezing defect) due to an angular change or bending of the press-formed product, which is called springback, generated after the metal plate is press-formed.

The springback is generated since the press-formed product is deformed by elastic recovery after the press forming due to residual stress introduced into the metal plate during the press forming. When the residual stress introduced into the metal plate is non-uniformly distributed in a plate thickness direction or an in-plane direction of the metal plate, the springback is easily generated.

In order to decrease the springback and improve the dimension accuracy of the press-formed product, in the end phase of the press forming, it is effective to increase a wrinkle suppression force with respect to a blank material during the press forming.

However, in order to increase the wrinkle suppression force during the press forming, a press forming apparatus, which includes a variable die cushion device using a servo valve or the like, is generally required.

With respect to this problem, Patent Document 1 discloses a press-forming tool in which an elastic body such as a spring is disposed in the press-forming tool. In this press-forming tool, it is possible to increase the wrinkle suppression force in the end phase of the press forming without the variable die cushion device.

Patent Document 2 discloses a press-forming tool in which the disc spring is disposed in the press-forming tool. In this press-forming tool, since the disc spring which can generate a high load even by a low stroke is used, it is possible to make the wrinkle suppression force which is increased in the end phase of the press forming be larger even without the variable die cushion device.

Patent Document 3 discloses a press-forming tool in which a wrinkle suppression mold is divided into a corner portion and a straight side portion. In this press-forming tool, it is possible to increase the wrinkle suppression force at every position in which the press forming is performed.

PRIOR ART DOCUMENT

Patent Document

[Patent Document 1] Japanese Unexamined Patent Application, First Publication No. 2002-321013

[Patent Document 2] Japanese Unexamined Patent Application, First Publication No. 2004-344925

[Patent Document 3] Japanese Unexamined Patent Application, First Publication No. 2003-94119

DISCLOSURE OF THE INVENTION

Problems to be Solved by the Invention

In the press-forming tool disclosed in Patent Document 1, even when the portion which is added an increased the wrinkle suppression force is a part of the entire wrinkle suppression portion, it is necessary to increase the wrinkle suppression force in the entire wrinkle suppression portion. That is to say, in order to suppress the springback of the press-formed product, it is necessary to increase the size of the spring disposed in the press-forming tool or to increase the number of the springs. However, a site capable of disposing the spring in the press-forming tool is limited. Accordingly, when a metal plate having a larger springback such as high tensile strength steel or high tensile strength aluminum alloy is press-formed as the blank material, it is difficult to sufficiently increase the wrinkle suppression force.

In the press-forming tool disclosed in Patent Document 2, as the spring for increasing the wrinkle suppression force, the disc spring capable of obtaining the reaction force of the high load by the low stroke is used. Accordingly, in the end phase of the press forming at which the increase of the wrinkle suppression force is needed, it is possible to effectively increase the wrinkle suppression force by a slight stroke. However, also in this press-forming tool, even when the portion which is added the increased wrinkle suppression force is a part of the entire wrinkle suppression portion, it is also necessary to increase the wrinkle suppression force of the entire wrinkle suppression portion. Therefore, in recent years, when a metal plate which is further high-strengthened is press-formed as the blank material, even if the disc spring is used, the increase of the wrinkle suppression force is not sufficient.

In the press-forming tool disclosed in Patent Document 3, in order to suppress occurrence of wrinkles (springback) in the corner portion of the press-formed product which becomes a shrinkage flange deformation region, the wrinkle suppression force in the early phase of the press-forming is increased. In addition, in order to avoid occurrence of breakage in the corner portion, the wrinkle suppression force during the press-forming is decreased. Moreover, in order to remove a shape freezing defect in the corner portion, the wrinkle suppression force is increased again immediately before a bottom dead center (press-forming ending point) of the press-forming.

However, in this press-forming tool, in order to change the wrinkle suppression force in a part of the entire wrinkle suppression portion, the wrinkle suppression mold is set as a split-type. Since the wrinkle suppression mold is the split-type, a large spring force is not required, and only the wrinkle suppression force in the required region is increased.

However, generally, compared to an integral-type mold, the split mold has many problems with respect to manufacturing, operation, maintenance, repair, replacement, life span, or the like of the mold. Accordingly, since the split mold is adopted, management of the manufacturing process of the press-formed product becomes complicated, and the manufacturing cost of the press-formed product may be increased. Therefore, in a mass production process of press-forming members for an automobile or the like, it is more preferable to change the wrinkle suppression force in a part of the entire wrinkle suppression portion not using the split-type wrinkle suppression mold but using the integral-type wrinkle suppression mold.

In addition, the integral wrinkle suppression mold refers to a wrinkle suppression mold constituted of the minimum number of components difficult to be further split, from the viewpoint of the manufacturing of the press mold and the shape of the press-formed product.

Moreover, the press-forming tool disclosed in Patent Document 3 is a press-forming tool for a drawing of the metal plate and is not suitable to press-form a high-strength metal plate. Specifically, in the press-forming tool disclosed in Patent Document 3, a steel sheet is mainly drawn in a deep cylindrical shape.

Accordingly, the shape of the press-formed product obtained by this press-forming tool is different from the shape of the press-formed product in which the high-strength metal plate is mainly press-formed. In the press mold in which the high-strength metal plate is used as the blank material drawing and bending processing is often performed to obtain a press-formed product in which both ends in the longitudinal direction are opened (hat-shaped cross-section).

When such the high strength metal plate is performed drawing and bending processing, there are problems which are different from the problems generated when the metal plate is drawn in a deep cylindrical shape.

In the drawing processing of making the metal plate into a deep cylindrical shape, the drawn corner portion of the press-formed product becomes a shrinkage flange deformation region. On the other hand, in the drawing and bending processing of making the high-strength metal plate into the shape (for example, a member part) having both ends opened in the longitudinal direction, a portion (for example, a flange portion corresponding to an inner side of a bent portion) of the corner portion of the press-formed product becomes an extension flange deformation region.

Here, the shrinkage flange deformation refers to deformation in which extension and shrinkage are simultaneously generated in two axes an in-plane, and the extension flange deformation refers to deformation in which the extension is generated in both two axes of the in-plane. That is to say, in the press-formed product drawn by the press-forming tool disclosed in Patent Document 3, the corner portion which becomes the extensions flange deformation region such as the member part does not exist. Moreover, in the drawn press-formed product, the plate thickness of the flange portion at which the shrinkage flange deformation is generated is not changed or is increased.

On the other hand, in the press-formed product after the drawing and bending processing, the plate thickness of the flange portion at which the extension flange deformation is generated is significantly decreased. In the region in which the plate thickness is significantly decreased during the press forming, the wrinkle suppression force is not easily transmitted to the blank material, and as a result, dimension accuracy defects such as wall warpage of the press-formed product or waviness of a vertical wall are easily generated.

Here, the drawing processing refers to press forming (processing) to obtain a vessel-shaped (cylindrical) press-formed product which does not have the region being generated the extension flange deformation and which does not have opening portions on both ends in a direction perpendicular to an advancement direction (pressing direction) of a punch. Moreover, the drawing and bending processing refers to press forming (processing) to obtain a member-shaped press-formed product which has the region being generated the extension flange deformation and has openings on both ends in the longitudinal direction (the extension direction of the flange portion to which the wrinkle suppression force is applied).

In the manufacturing process in which the high-strength metal plate is press-formed in a member part or the like, development of a press-forming tool capable of suppressing springback at a portion which becomes the extension flange deformation region in addition to the shrinkage flange deformation region is significantly required.

In consideration of the above-described circumferences, an object of the present invention is to provide a press-forming tool in which a wrinkle suppression mold is not a split-type but an integral-type and springback can be suppressed in a portion which becomes an extension flange deformation region even when a high-strength metal plate is press-formed as a blank material, and a method for manufacturing a press-formed product which is press-formed using the press-forming tool.

That is to say, the present invention provides a press-forming tool and a method for manufacturing a press-formed product in which a general press forming apparatus is used without a press forming apparatus having a variable die cushion device, and a press-formed product having high dimension accuracy can be obtained by sufficiently increasing a wrinkle suppression force with respect to a blank material in the end phase of the press forming when a metal plate such as high tensile strength steel or high strength aluminum alloy in which springback easily occurs is press-formed as a blank material.

Particularly, another object of the present invention is to provide a press-forming tool and a method for manufacturing a press-formed product in which a press-formed product having an extension flange deformation region in addition to a shrinkage flange deformation region can be press-formed with high dimension accuracy by a press-forming tool by which a metal plate is performed drawing and bending processing.

Means for Solving the Problem

The inventors earnestly reviewed a mold structure in which a wrinkle suppression force is effectively increased at a portion which is added the increased wrinkle suppression force, in a press-formed product having an extension flange deformation region such as a member part. As a result, the inventors found a providing of a pressure receiving portion on a portion of a wrinkle suppression mold of the press-forming tool and providing of a wrinkle suppression force increasing portion on a portion of a punch of the press-forming tool.

According to this configuration, in the end phase of the press forming, the pressure receiving portion and the wrinkle suppression force increasing portion come into contact with each other, the wrinkle suppression mold is elastically deformed and bent, and thus, the wrinkle suppression force can be locally added to a portion of the blank material which is added the increased wrinkle suppression force. Springback of a press-formed product having the extension flange deformation region such as a member part can be significantly decreased.

Here, the part having the extension flange deformation region such as the member part refers to a press-formed product having a hat-shaped cross section shape in which both ends in the longitudinal direction are opened.

The gist of the present invention is as follows.

(1) According to an aspect of the present invention, there is provided a press-forming tool comprising: a punch which includes a punch portion and a plate portion which are configured to transfer a shape to a blank material; a die which is paired with the punch and opposes the punch portion; a wrinkle suppression mold which includes a first surface which opposes the plate portion and comes into contact with the plate portion at a press-forming ending point, a second surface which opposes the die and holds the blank material along with the die, and a third surface which is continuous between the first surface and the second surface and opposes the punch portion, and is disposed between the third surface and the punch portion via a gap; a pressure receiving portion which includes a groove portion and which is disposed on the first surface of the wrinkle suppression mold; and a wrinkle suppression force increasing portion which is disposed on the plate portion so as to oppose the first surface, protrudes toward the pressure receiving portion, and generates a reaction force in a direction opposite to a pressing direction when being pressed in the pressing direction in an end phase of a press forming.

(2) In the press-forming tool according to (1), when a region in which a plate thickness is maximum in a flange portion of a press-formed product is defined as a plate thickness maximum portion and a region in which the plate thickness is more than 0% and less than or equal to 97% with respect to the plate thickness maximum portion is defined as a plate thickness decreasing portion, based on a case where the pressure receiving portion and the wrinkle suppression force increasing portion are removed from the press-forming tool, the pressure receiving portion may overlap with a portion of a region corresponding to the plate thickness decreasing portion in the blank material when viewed along the pressing direction.

(3) In the press-forming tool according to (1) or (2), the pressure receiving portion is consisted of the groove portion, wherein when a thickness of the wrinkle suppression mold in a position of the groove portion is defined as L in mm units and a minimum value of the thickness of the wrinkle suppression mold in a position which excludes the groove portion and comes into contact with the blank material is defined as H in mm units, the wrinkle suppression mold may satisfy a following Expression 1 or 2, and when a protruding height of the wrinkle suppression force increasing portion is defined as G in mm units and a press stroke distance from a press-forming starting point to the press-forming ending point is defined as PS in mm units, and the protruding height G of the wrinkle suppression force increasing portion may satisfy a following Expression 3:

$$20 \leq L \leq 0.8 \times H \text{ when } 40 \leq H \leq 50 \quad \text{(Expression 1)}$$

$$20 \leq L \leq 40 \text{ when } 50 < H \leq 80 \quad \text{(Expression 2)}$$

$$0.02 \times PS + H - L \leq G \leq 0.3 \times PS + H - L \quad \text{(Expression 3).}$$

(4) In the press-forming tool according to (1) or (2), a portion of a boundary which partitions the pressure receiving portion may be the groove portion.

(5) In the press-forming tool according to any one of (1) to (4), the wrinkle suppression force increasing portion may include an elastic body which applies the reaction force.

(6) In the press-forming tool according to any one of (1) to (5), the elastic body may be at least one of a disc spring, a helical spring, and a rubber.

(7) According to another aspect of the present invention, there is provided a method for manufacturing a press-formed product which is press-formed using the press-forming tool according to any one of (1) to (6), including a step of increasing a wrinkle suppression force with respect to a portion of a blank material in an end phase of a press forming, which is started from a position at which a press stroke is 2% to 30% and which is ended at a forming end position, when a forming start position of the press stroke is defined as 100% and the forming end position of the press stroke is defined as 0% during the press forming of the blank material.

Effects of the Invention

According to the above-described aspects of the present invention, a pressure receiving portion is provided on a portion of a wrinkle suppression mold, and a wrinkle suppression force increasing portion is provided on a portion of a punch. The pressure receiving portion and the wrinkle suppression force increasing portion come into contact with each other in the end phase of the press forming, and thus, the wrinkle suppression mold is elastically deformed. As a result, the wrinkle suppression force generated from the wrinkle suppression force increasing portion is sufficiently transmitted to the portion of a blank material which is added the increased wrinkle suppression force in the end phase of press forming.

That is to say, even when the press-formed product includes an extension flange deformation region in addition to a shrinkage flange deformation region, springback of the press-formed product can be effectively decreased.

In a press-formed product which is press-formed using a press-forming tool of the related art in which the pressure receiving portion and the wrinkle suppression force increasing portion are removed from the press-forming tool, when a portion in which a plate thickness of a flange portion is thinned is defined as a plate thickness decreasing portion, according to the above-described aspects of the present invention, a portion (a portion which is added an increased the wrinkle suppression force) of a region corresponding to the plate thickness decreasing portion of the blank material and the pressure receiving portion overlap with each other when viewed along the pressing direction.

Accordingly, the wrinkle suppression force at the portion which is added the increased wrinkle suppression force is preferably increased in the end phase of the press forming. As a result, even when the press-formed product includes the extension flange deformation region in addition to the shrinkage flange deformation region, springback of the press-formed product can be further decreased.

In addition, according to the above-described aspects of the present invention, even when a metal plate, in which the springback easily occurs, such as high tensile strength steel or high strength aluminum alloy, is used as the blank material, an integral-type wrinkle suppression mold, which is a general press forming apparatus which does not include a variable die cushion device and which is not a split-type is used, and even when the press-formed product includes the extension flange deformation region in addition to the shrinkage flange deformation region, it is possible to obtain a press-formed product having high dimension accuracy.

EMBODIMENTS OF THE INVENTION

Figure 1A:
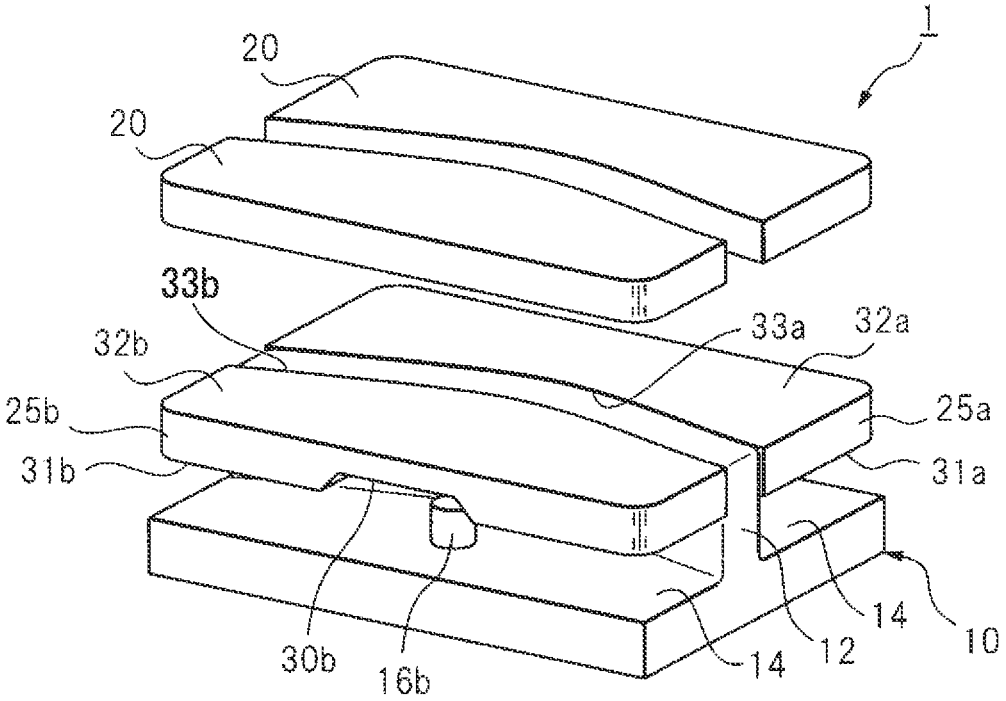
FIG. 1A is a view showing a schematic configuration of a press-forming tool according to a first embodiment of the present invention, and is a perspective view showing the entirety thereof.

Hereinafter, each embodiment of the present invention will be described in detail with reference to the drawings.

However, the present invention is not limited to only the configurations of the following embodiments, and various modifications may be applied to the present invention within a scope which does not depart from the gist of the present invention. Moreover, in the drawings used for the following description, in order to make the description easier to be understood, for convenience, a portion becoming a main portion may be shown to be enlarged, and it is not limited that a dimension ratio of each component or the like is the same as the actual condition.

Figure 1B:
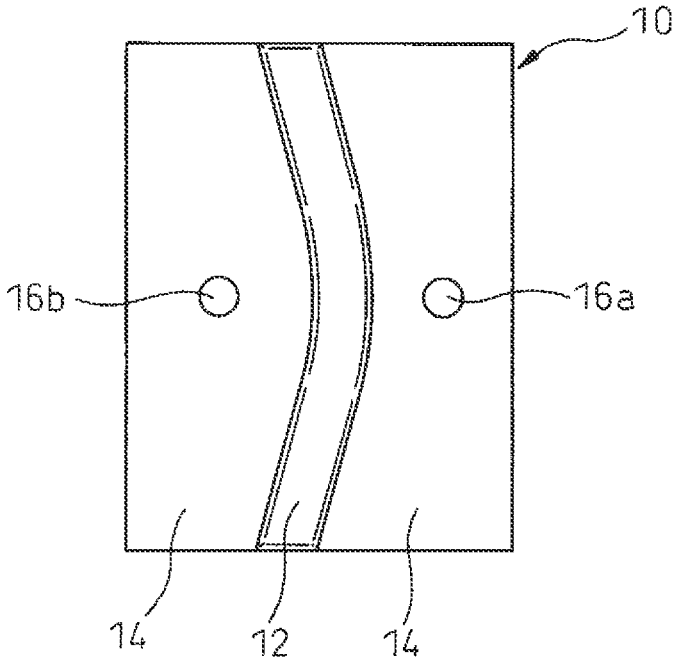
FIG. 1B is a plan view of a punch of the press-forming tool according to the first embodiment.

FIGS. 1A and 1B are views showing a schematic configuration of a press-forming tool according to a first embodiment of the present invention. FIG. 1A is a perspective view showing the entirety thereof and FIG. 1B is a plan view of a punch configuring the press-forming tool. In FIG. 1A, a reference numeral 1 indicates the press-forming tool according to the present embodiment.

The press-forming tool 1 according to the present embodiment includes a punch 10, a die 20, and wrinkle suppression molds 25*a* and 25*b*. The punch 10 includes a punch portion 12 and a plate portion 14 configured to transfer a shape to a blank material. The punch portion 12 and the plate portion 14 are fixed to each other by a fastening member (not shown) and become the punch 10. Alternatively, the punch portion 12 and the plate portion 14 may integrally form the punch 10.

As shown in FIG. 1B, wrinkle suppression force increasing portions 16*a* and 16*b* are disposed on a surface of the plate portion 14 opposing the wrinkle suppression molds 25*a* and 25*b*. The wrinkle suppression force increasing portions 16*a* and 16*b* protrude toward the wrinkle suppression molds 25*a* and 25*b* and generate a reaction force in a direction opposite to a pressing direction when the wrinkle suppression force increasing portions are pressed in the pressing direction in the end phase of press forming.

The die 20 is paired with the punch 10 and is disposed so as to oppose the punch portion 12. The wrinkle suppression molds 25*a* and 25*b* are disposed between the punch 10 and the die 20. The wrinkle suppression molds 25*a* and 25*b* according to the present embodiment are constituted of the minimum number of components, which is difficult to divide it further, from the viewpoint of a structure of a press mold and a shape of a press-formed product. That is to say, the wrinkle suppression molds 25*a* and 25*b* are not split-type wrinkle suppression molds but integral-type wrinkle suppression molds.

The wrinkle suppression molds 25*a* and 25*b* include first surfaces 31*a* and 31*b* which oppose the plate portion 14 of the punch 10 and which come into contact with the plate portion 14 at a press-forming ending point. In addition, the wrinkle suppression molds 25*a* and 25*b* include second surfaces 32*a* and 32*b* which oppose the die 20 and which hold the blank material along with the die 20.

A side surface (third surface) 33*a* which is continuous between the first surface 31*a* and the second surface 32*a* oppose the punch portion 12 via a predetermined gap (clearance). Similarly, a side surface (third surface) 33*b* which is continuous between the first surface 31*b* and the second surface 32*b* oppose the punch portion 12 via a predetermined gap (clearance). By setting the gap appropriately, occurrence of wrinkles of the press-formed product or cracks of the press-formed product can be preferably prevented. The setting of the gap may be determined according to a routine procedure.

Figure 2:
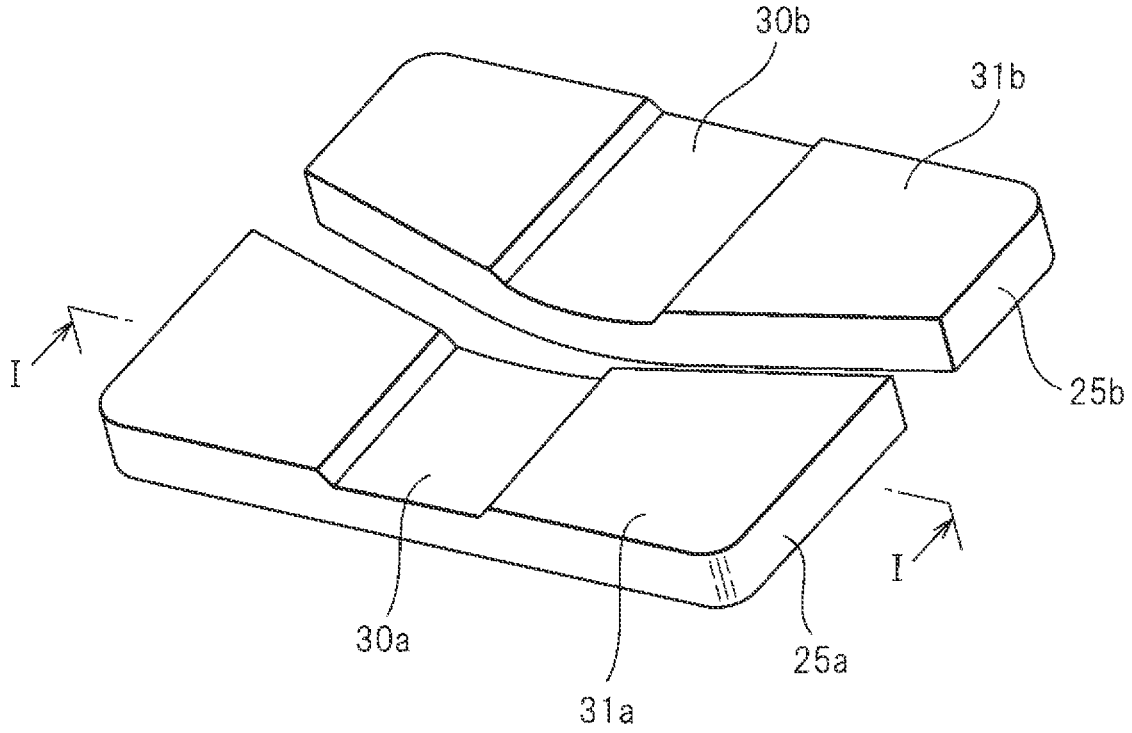
FIG. 2 is a view showing a wrinkle suppression mold of the press-forming tool according to the first embodiment and is a perspective view when viewed from a first surface side.

FIG. 2 is a perspective view when the wrinkle suppression molds 25*a* and 25*b* are viewed from the first surfaces 31*a* and 31*b* sides. As shown in FIG. 2, the wrinkle suppression molds 25*a* and 25*b* include pressure receiving portions (groove portions) 30*a* and 30*b*, which receive the reaction force to elastically deform the wrinkle suppression molds 25*a* and 25*b* in the end phase of the press forming, on the first surfaces 31*a* and 31*b*. In the press-forming tool 1 according to the present embodiment, each of the pressure receiving portions 30*a* and 30*b* is formed of a groove portion. In the end phase of the press forming, the wrinkle suppression force increasing portions 16*a* and 16*b* come into contact with the pressure receiving portions 30*a* and 30*b* and are pressed in the pressing direction. If the reaction force is generated in a direction opposite to the pressing direction, the wrinkle suppression molds 25*a* and 25*b* receive the reaction force and are elastically deformed.

Figure 3A:
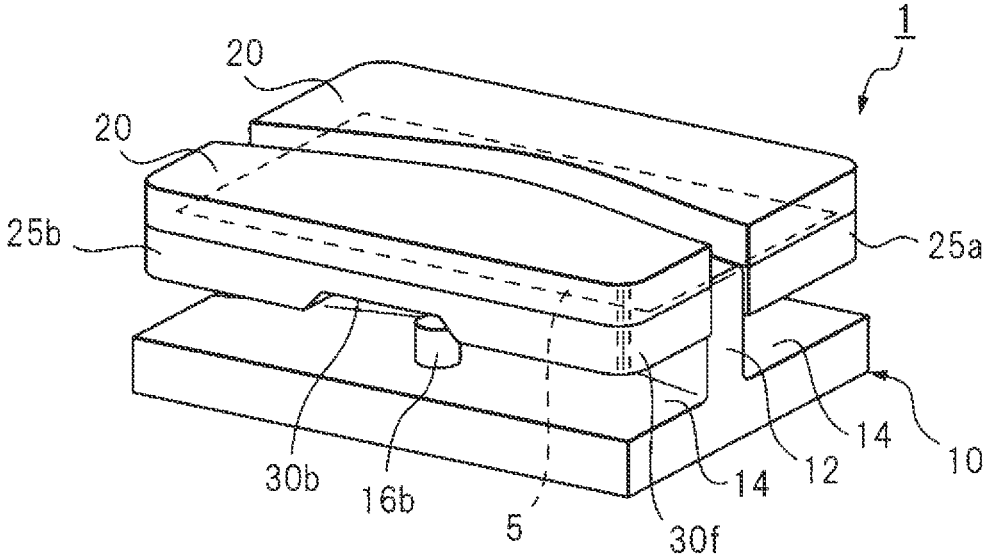
FIG. 3A is an explanatory view schematically showing movements of the punch, a die, and the wrinkle suppression mold when a blank material is press-formed, and is a perspective view when the press forming starts.
Figure 3B:
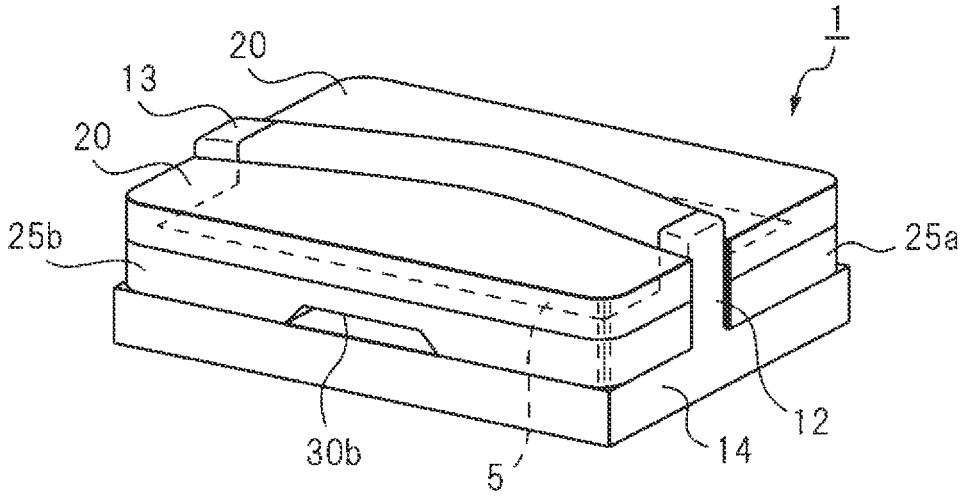
FIG. 3B is an explanatory view schematically showing the movements of the punch, the die, and the wrinkle suppression mold when the blank material is press-formed, and is a perspective view during the press forming.

FIGS. 3A and 3B are explanatory views schematically showing the movements of the punch 10, the die 20, and the wrinkle suppression molds 25*a* and 25*b* when the blank material 5 is press-formed. FIG. 3A is a perspective view when the press forming starts, and FIG. 3B is a perspective view during the press forming.

A blank material 5 is disposed on the second surfaces 32*a* and 32*b* of the wrinkle suppression molds 25*a* and 25*b* in a state where the second surfaces 32*a* and 32*b* of the wrinkle suppression molds 25*a* and 25*b* and a tip surface 13 of the punch portion 12 are flush with each other.

As shown in FIG. 3A, the die 20 is lowered in the pressing direction, and a flange portion of the blank material 5 is held by a constant load by the die 20 and the wrinkle suppression molds 25*a* and 25*b*.

Moreover, as shown in FIG. 3B, in the state where the blank material 5 is held by the die 20 and the wrinkle suppression molds 25*a* and 25*b*, the die 20 moves in the pressing direction, that is to say, a direction of the plate portion 14 of the punch 10 (downward in FIG. 3B), and thus, the press forming of the blank material 5 is performed by the punch portion 12.

At a predetermined position in the end phase of the press forming, the pressure receiving portions 30*a* and 30*b* provided on the first surfaces 31*a* and 31*b* of the wrinkle suppression molds 25*a* and 25*b* come into contact with the wrinkle suppression force increasing portions 16*a* and 16*b*. Moreover, the pressure receiving portions 30*a* and 30*b* press the wrinkle suppression force increasing portions 16*a* and 16*b* in the pressing direction in conjunction with the press forming from the predetermined position of the end phase of the press forming to the press-forming ending point.

As a result, the reaction force in the direction opposite to the pressing direction is generated from the wrinkle suppression force increasing portions 16*a* and 16*b*. The pressure receiving portions 30*a* and 30*b* receive the reaction force, and the wrinkle suppression force with respect to the blank material 5 in the end phase of the press forming is increased.

Figure 4A:
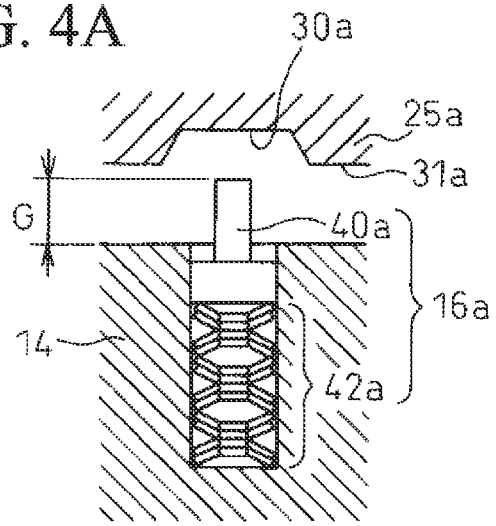
FIG. 4A is a view showing a wrinkle suppression force increasing portion of the press-forming tool according to the first embodiment, and a vertical cross-sectional view showing a state where a wrinkle suppression force is not increased when a plurality of disc springs are piled.
Figure 4B:
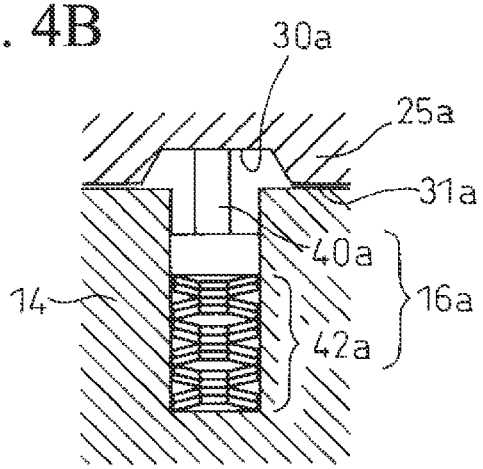
FIG. 4B is a view showing the wrinkle suppression force increasing portion of the press-forming tool according to the first embodiment, and a vertical cross-sectional view showing a state where the wrinkle suppression force is increased when the plurality of disc springs are piled.

FIGS. 4A and 4B are vertical cross-sectional views showing when a plurality of disc springs overlap with each other as the wrinkle suppression force increasing portions. FIG. 4A shows a state where the wrinkle suppression force is not increased, and FIG. 4B shows a state where the wrinkle suppression force is increased.

As shown in FIG. 4A, the wrinkle suppression force increasing portion 16*a* includes a pin 40*a* and a disc spring 42*a*. In this way, the wrinkle suppression force increasing portion 16*a* includes an elastic body which applies the reaction force. In the present embodiment, 12 disc springs 42*a* pile in parallel and in series. However, the number and arrangement of the disc springs 42*a* are not limited to this. For example, 4 disc springs 42*a* may pile in series. Although it is not shown, the wrinkle suppression force increasing portion 16*b* is similar to the above-described configuration.

Instead of the disc spring 42*a*, an elastic body such as a helical spring or a rubber may be used. It is preferable that the disc spring 42*a* is used since it is possible to obtain a high load even by a low stroke.

As shown in FIG. 4B, the pressure receiving portion 30*a* provided on the first surface 31*a* of the wrinkle suppression mold 25*a* presses the pin 40*a* in the pressing direction, and thus, the disc spring 42*a* is compressed. The wrinkle suppression mold 25*a* receives the reaction force in the direction opposite to the pressing direction from the disc spring 42*a*.

As a result, the reaction force is transmitted to the blank material 5 which is held between the second surface 32*a* of the wrinkle suppression mold 25*a* and the die 20, and thus, the wrinkle suppression force with respect to the blank material 5 can be increased in the end phase of the press forming.

The wrinkle suppression mold 25*a* which receives the reaction force from the disc spring 42*a* includes the pressure receiving portion 30*a* which is constituted of a groove portion, and thus, the wrinkle suppression mold 25*a* is convexly and elastically deformed to the blank material 5 side and is bent. That is to say, when viewed along the pressing direction, a portion which is convexly and elastically deformed on the second surface 32*a* corresponding to the pressure receiving portion 30*a* effectively transmits the reaction force to the blank material 5. Here, the pressure receiving portion 30*a* is formed on the first surface 31*a* of the wrinkle suppression mold 25*a*.

If the wrinkle suppression mold 25*a* does not include the pressure receiving portion 30*a*, the reaction force from the disc spring 42*a* is distributed to the entire wrinkle suppression mold 25*a*. Accordingly, since the reaction force cannot be locally applied to the blank material 5, the transmission efficiency of the reaction force is decreased.

Figure 5:
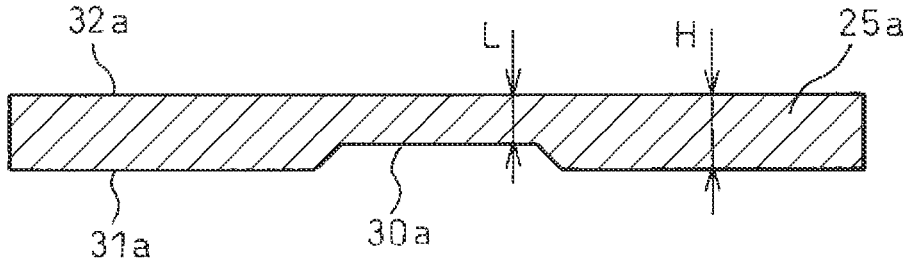
FIG. 5 is a vertical cross-sectional view when viewed from an arrow I direction shown in FIG. 2.

FIG. 5 is a view explaining a thickness of the wrinkle suppression mold 25*a*, and is a vertical cross-sectional view when the wrinkle suppression mold 25*a* is viewed from an arrow I direction shown in FIG. 2. As shown in FIG. 5, the thickness of the wrinkle suppression mold 25*a* on the pressure receiving portion 30*a* which is constituted of a groove portion is defined as L in mm units. Moreover, the thickness of the wrinkle suppression mold 25*a* on the region which excludes the pressure receiving portion 30*a* and which comes into contact with the blank material 5 is defined as H in mm units.

Figure 27:
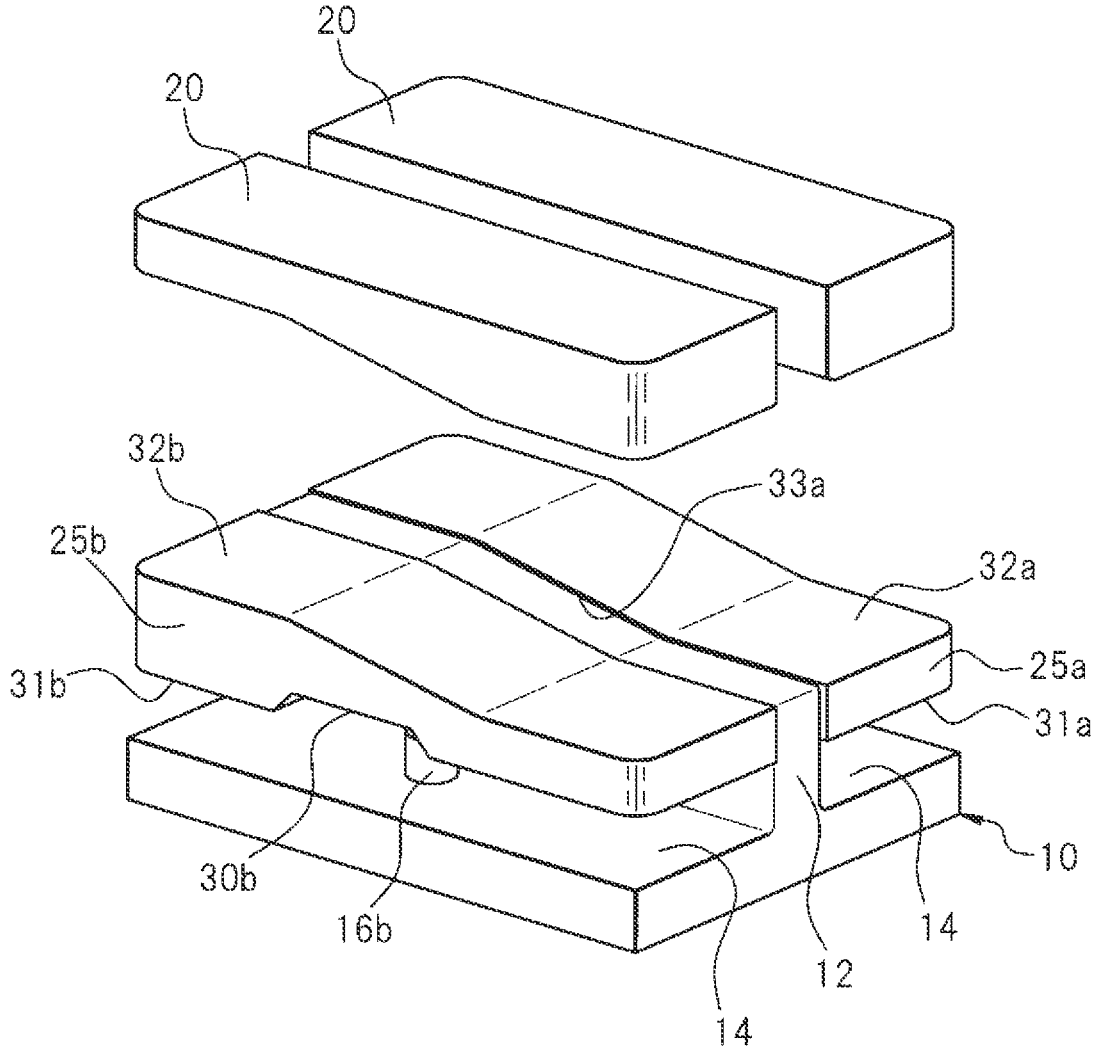
FIG. 27 is a view showing an example of a press-forming tool in which the thickness of the wrinkle suppression mold is not constant, and is a perspective view showing the entirety thereof.

In the press-forming tool 1 according to the present embodiment, the thickness H is constant. However, when the thickness is not constant, the minimum value of the thickness on the region which excludes the pressure receiving portion 30*a* and comes into contact with the blank material 5 may be set to H. For example, as the case where the thickness H is not constant, there is a case where a press-formed product in which the height of the flange surface is not constant is formed, as shown in FIG. 27.

The lower limit of the thickness L is preferably set to 20 mm. If the thickness L is less than 20 mm, the wrinkle suppression mold 25*a* may be plastically deformed or damaged during drawing and bending processing (during press forming).

On the other hand, in the case of $40 \leq H \leq 50$, the upper limit of the thickness L is preferably set to $0.8 \times H$. If the thickness L exceeds $0.8 \times H$, even when the pressure receiving portion 30*a* receives the reaction force from the wrinkle suppression force increasing portion 16*a*, the wrinkle suppression mold 25*a* is not elastically deformed, and thus, the reaction force may not be effectively transmitted to the blank material 5.

In the case of $40 \leq H \leq 50$, the preferable upper limit of the thickness L is $0.6 \times H$. If the upper limit of the thickness L is $0.6 \times H$, even when capability of the wrinkle suppression force increasing portion 16*a* is small, the reaction force generated by the wrinkle suppression force increasing portion 16*a* can be effectively transmitted to the blank material 5.

In the case of $50 < H \leq 80$, the upper limit of the thickness L is preferably set to 40 mm regardless of the thickness H. The maximum value of the reaction force, which is received from the wrinkle suppression force increasing portion 16*a* to the pressure receiving portion 30*a*, is 6.5 MPa. Accordingly, if the thickness L exceeds 40 mm, stiffness of the pressure receiving portion 30*a* is increased, and the wrinkle suppression mold 25 may not be elastically deformed even by the maximum value of the reaction force.

If the thickness H is less than 40 mm, the stiffness of the entire wrinkle suppression mold 25*a* is not sufficient. On the other hand, if the thickness H exceeds 80 mm, the stiffness of the wrinkle suppression mold 25*a* is increased more than necessary, and a material cost of the wrinkle suppression mold 25*a* is also increased.

In summary about the thicknesses of the wrinkle suppression mold 25*a*, a relationship between the thickness L and the thickness H preferably satisfies the relationship of the following Expression 1 or 2. Moreover, although it is not shown, the wrinkle suppression mold 25*b* is also similar to the above.

$$20 \leq L \leq 0.8 \times H \text{ when } 40 \leq H \leq 50 \quad \text{(Expression 1)}$$

$$20 \leq L \leq 40 \text{ when } 50 < H \leq 80 \quad \text{(Expression 2)}$$

The reaction force from the wrinkle suppression force increasing portion 16*a* is generated from contacting the pressure receiving portion 30*a* provided on the wrinkle suppression mold 25*a* with the pin 40*a*, until the pressure receiving portion 30*a* reaches the press-forming ending point. The position of contacting the pressure receiving portion 30*a* provided on the wrinkle suppression mold 25*a* with the pin 40*a* may be a predetermined position in the end phase of the press forming. The position of contacting the pressure receiving portion 30*a* with the pin 40*a* may be controlled by changing the protruding length (height) of the tip of the pin 40*a* from the surface of the plate 14.

As shown in FIG. 4A, a protruding height G of the tip of the pin 40*a* from the surface of the plate 14 may be a height which adds a groove depth (a value which is obtained by subtracting L from H) of the pressure receiving portion 30*a* which is constituted of a groove portion and a distance from the surface of the plate portion 14 to the above-described predetermined position which is added the increased wrinkle suppression force in the end phase of the press forming.

The protruding height of the tip of the pin 40*a* of the wrinkle suppression force increasing portion 16*a* from the surface of the plate 14 is defined as G in mm units. A press stroke distance from a press-forming starting point, which is a press stroke position at which the plastic deformation of the blank material 5 starts, to the press-forming ending point is defined as PS in mm units. At this time, the protruding height G of the wrinkle suppression force increasing portion 16*a* may preferably satisfy the following Expression 3. Moreover, although it is not shown, the wrinkle suppression force increasing portion 16*b* is also similar to the above.

$$0.02 \times PS + H - L \leq G \leq 0.3 \times PS + H - L \quad \text{(Expression 3)}$$

The protruding height G of the pin 40*a* is preferably equal to or more than a value which adds the groove depth (H−L) of the pressure receiving portion 30*a* to 2% of the press stroke distance PS (0.02×PS). That is to say, the interval of the press stroke which increase the wrinkle suppression force in the end phase of the press forming is preferably equal to or more than 2% of the press stroke distance PS.

If the protruding height G is less than the value (0.02×PS+H−L), the increase of the wrinkle suppression force is not sufficient, and the effects which is exerted by decreasing the springback may be unstable. In order to further decrease the springback, the value of the protruding height G is preferably equal to or more than (0.05×PS+H−L).

On the other hand, it is preferable that the protruding height G of the pin 40*a* be less than or equal to a value which adds the groove depth (H−L) of the pressure receiving portion 30*a* to 30% of the press stroke distance PS (0.3×PS). That is to say, the interval of the press stroke which increases the wrinkle suppression force in the end phase of the press forming is preferably less than or equal to 30% of the press stroke distance PS.

If the protruding height G exceeds the value (0.3×PS+H−L), since the interval of increasing the wrinkle suppression force becomes too long, a difference in the wrinkle suppression force becomes smaller between the press-forming starting point and the press-forming ending point. Accordingly, the effect which is exerted by increasing the wrinkle suppression force is decreased only in the end phase of the press forming is decreased, and thus, the springback may occur to the contrary. In order to further decrease the springback, the value of the protruding height G is preferably less than or equal to (0.15×PS+H−L).

So far, it is mainly described regarding the wrinkle suppression mold 25*a* and the wrinkle suppression force increasing portion 16*a*. However, the wrinkle suppression mold 25*b* and the wrinkle suppression force increasing portion 16*a* are similar to the above.

Figure 6A:
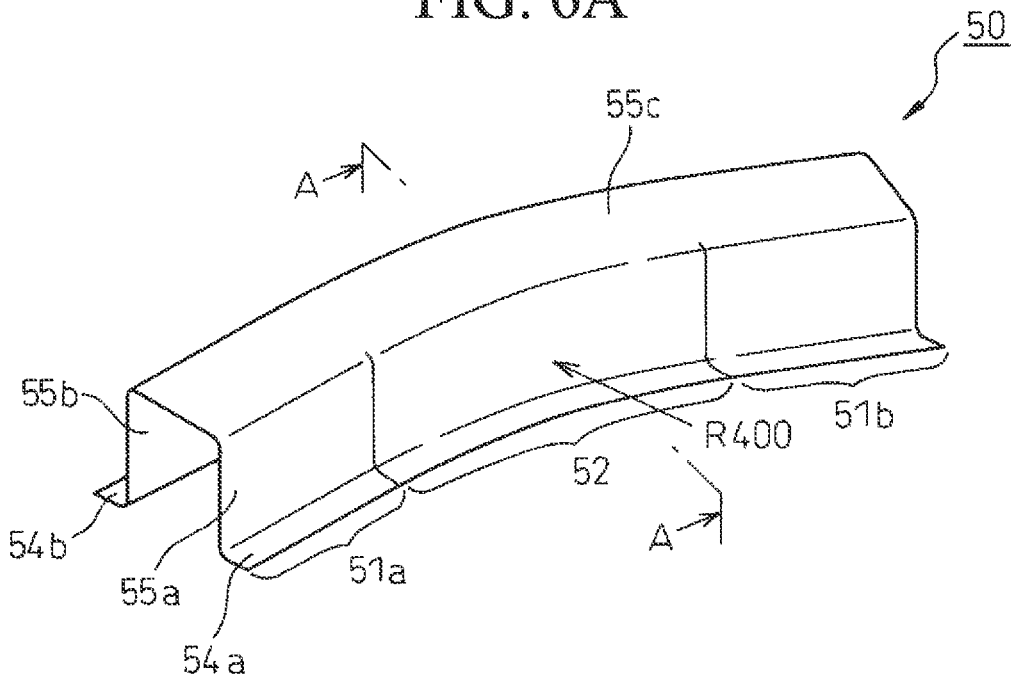
FIG. 6A is a perspective view showing a press-formed product which is formed by the press-forming tool according to the first embodiment.
Figure 6B:
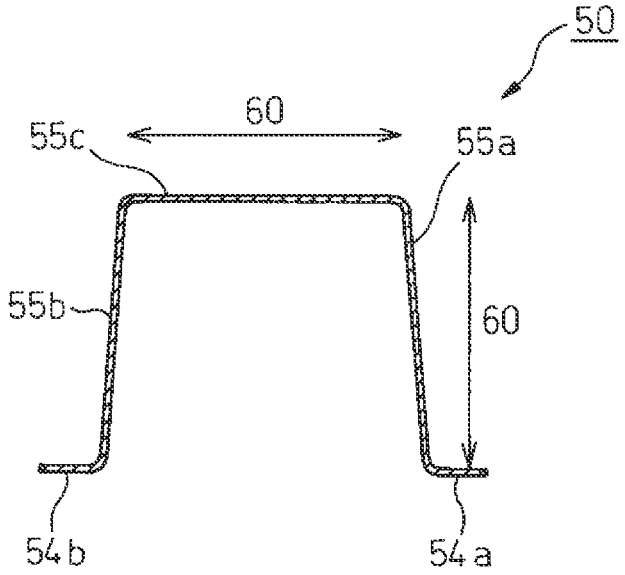
FIG. 6B is a vertical cross-sectional view when viewed from an arrow A direction in FIG. 6A.

FIGS. 6A and 6B show the press-formed product which is formed by the press-forming tool 1 according to the present embodiment. FIG. 6A is a perspective view, and FIG. 6B is a vertical cross-sectional view when viewed from an arrow A direction in FIG. 6A. In FIGS. 6A and 6B, a reference numeral 50 indicates the press-formed product.

The press-formed product 50 includes flange portions 54*a* and 54*b*, vertical wall portions 55*a* and 55*b*, and a top portion 55*c*. Moreover, straight side portions 51*a* and 51*b* and a bent portion 52 interposed between the straight side portions 51*a* and 51*b* are provided on both ends of the press-formed product 50.

When viewed from the cross section perpendicular to the longitudinal direction, the press-formed product 50 has a so-called hat-shaped cross section, and both ends in the longitudinal direction of the press-formed product 50 are opened. Here, when viewed from an arrow A direction in FIG. 6A, the hat-shaped cross section is a shape which includes the top portion 55*c* provided on the center portion in the width direction, the vertical wall portions 55*a* and 55*b* provided to be inclined from both ends of the top portion 55*c* toward one surface side of the top portion 55*c*, and the flange portions 54*a* and 54*b* provided to be parallel with the top portion 55*c* from the tips of the vertical wall portions 55*a* and 55*b*.

When the press forming is performed, according to the shape of the press-formed product 50, it is generated that a portion in which a plastic flow of the blank material 5 is easily occurred and a portion in which the plastic flow is not easily occurred. According to a difference in ease of the generation of the plastic flow, non-uniformity of residual stress in a plate thickness direction or an in-plane direction of the press-formed product 50 occurs.

Moreover, due to the non-uniformity of the residual stress, for example, springback such as warpage, twist, or waviness of the vertical wall portions 55*a* and 55*b* occurs on the press-formed product 50. Particularly, when the shape of the press-formed product 50 has a curved portion, shrinkage flange deformation or extension flange deformation is applied in the longitudinal direction of the press-formed product 50. Accordingly, the non-uniformity of the residual stress in the plate thickness direction or the in-plane direction is increased.

In general, after the drawing and bending processing is performed, finishing processing (restriking processing) is performed to the press-formed product 50. According to the restriking processing, when the press-formed product 50 is processed to the shape of a press-formed product 57 shown in FIGS. 16A and 16B described below, remarkable waviness occurs on the vertical wall portion 55*a* or the like of the bent portion 52.

In order to decrease dimension accuracy defects of the press-formed product 57, in general, an advanced estimation of a deformation amount generated by the springback into mold dimensions at the time of design is often performed. However, when the springback is waviness, it is difficult to estimate the deformation amount in advance.

In addition, since correction of the mold in order to solve the waviness of the press-formed product 57 includes trial and error, a lot of time and costs are required for the correction of the mold.

The waviness is generated since the vertical wall portion 55*a* of the bent portion 52 becomes the extension flange deformation region by the drawing and bending processing (press forming). Accordingly, tensile stress in the longitudinal direction of the press-formed product 50 is increased, and the non-uniformity of the residual stress in the plate thickness direction or the in-plane direction of the press-formed product 50 is promoted.

Due to the non-uniformity of the residual stress of the press-formed product after drawing and bending processing 50, waviness occurs on the press-formed product after restriking processing 57. Accordingly, in order to remove the waviness of the bent portion 52, the wrinkle suppression force applied to the bent portion 52 is preferably increased in the end phase of the press forming of the draw-bending processing.

In order to increase the wrinkle suppression force applied to the bent portion 52 in the end phase of the press forming compared to the straight side portions 51*a* and 51*b*, as shown in FIGS. 1A to 2, the pressure receiving portion 30*a* is provided on the wrinkle suppression mold 25*a* and the pressure receiving portion 30*b* is provided on the wrinkle suppression mold 25*b*. In order to elastically deform the wrinkle suppression molds 25*a* and 25*b* in the end phase of the press forming, the wrinkle suppression force increasing portions 16*a* and 16*b* are disposed on the plate portion 14.

As described above, the wrinkle suppression force is increased in the end phase of the press forming, and thus, tension of the vertical wall portion 55*a* of the bent portion 52, which is the region in which the extension flange deformation occurs, is increased. As a result, the non-uniformity of the residual stress in the plate thickness direction or the in-plane direction, which occurs the springback, of the press-formed product 50 is decreased.

The region in which the shrinkage flange deformation occurs is also similar to the above. That is to say, as described above, the wrinkle suppression force is increased in the end phase of the press forming, and thus, tension of the vertical wall portion 55*b* of the bent portion 52 which is the region in which the shrinkage flange deformation occurs is also increased. As a result, the springback at the region in which the shrinkage flange deformation occurs is also decreased.

When the pressure receiving portions 30*a* and 30*b* are not provided on the wrinkle suppression molds 25*a* and 25*b*, the wrinkle suppression molds 25*a* and 25*b* are not elastically deformed. The reaction force from the wrinkle suppression force increasing portions 16*a* and 16*b* is distributed on the entire wrinkle suppression molds 25*a* and 25*b*. Accordingly, the wrinkle suppression force cannot be locally increased on the bent portion 52 in the end phase of the press forming, and thus, the wrinkle suppression force needed in the bent portion 52 cannot be applied.

As a result, tension which is necessary to suppress the springback cannot be applied on the vertical wall portions 55*a* and 55*b* of the bent portion 52. Accordingly, effects which is exerted by decreasing the springback of the press-formed product 50 are significantly decreased.

In order to decrease the distribution of the reaction force from the above-described wrinkle suppression force increasing portions 16*a* and 16*b* by increasing capability of the wrinkle suppression force increasing portions 16*a* and 16*b*, for example, it is necessary to increase the diameter of the disc spring 42*a* or increase the number of the disc springs 42. In this case, the sizes of the wrinkle suppression force increasing portions 16*a* and 16*b* are increased.

On the other hand, in order to press-form a metal plate having a large plastic flow resistance and large springback such as high tensile strength steel or high strength aluminum alloy, since the shape of the press-formed product 50 is curved, it is particularly necessary to increase the wrinkle suppression force in the end phase of the press forming on the region in which the extension flange deformation or the shrinkage flange deformation occurs, or the like.

Accordingly, when the high tensile strength steel, the high strength aluminum alloy, or the like is press-formed, and in the case of decreasing the distribution of the reaction force by increasing the capability of the wrinkle suppression force increasing portions 16*a* and 16*b*, it is necessary to significantly increase the sizes of the wrinkle suppression force increasing portions 16*a* and 16*b*. Accordingly, it is difficult to dispose the wrinkle suppression force increasing portions 16*a* and 16*b* on the press-forming tool 1.

Figure 7A:
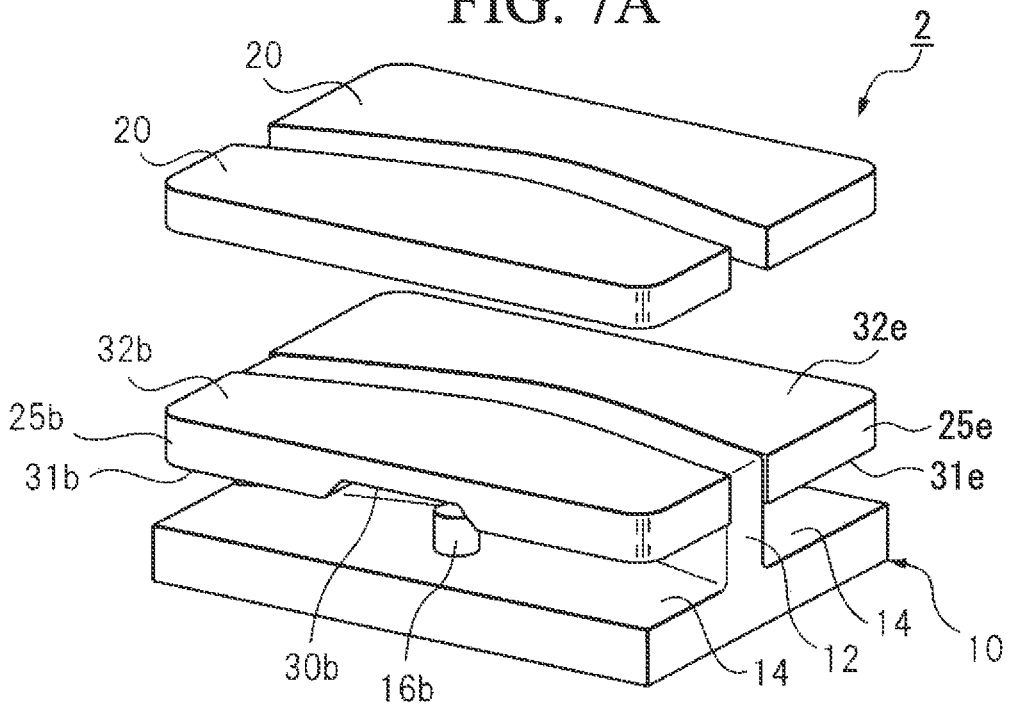
FIG. 7A is a view showing a schematic configuration of a press-forming tool according to a second embodiment of the present invention, and is a perspective view showing the entirety thereof.
Figure 7B:
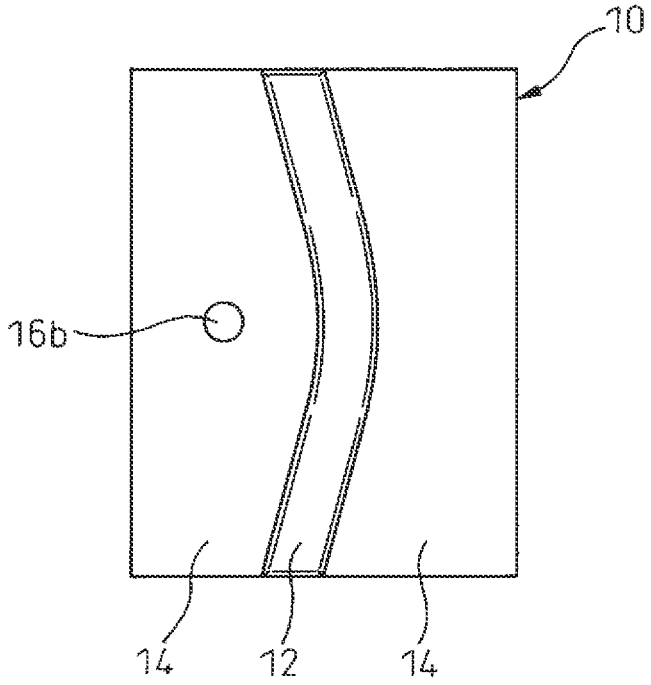
FIG. 7B is a plan view of a punch of the press-forming tool according to the second embodiment.

Next, a press-forming tool according to a second embodiment of the present invention will be described. FIGS. 7A and 7B are views showing a schematic configuration of the press-forming tool according to the second embodiment of the present invention. FIG. 7A is a perspective view showing the entirety thereof and FIG. 7B is a plan view of a punch configuring the press-forming tool.

Figure 8:
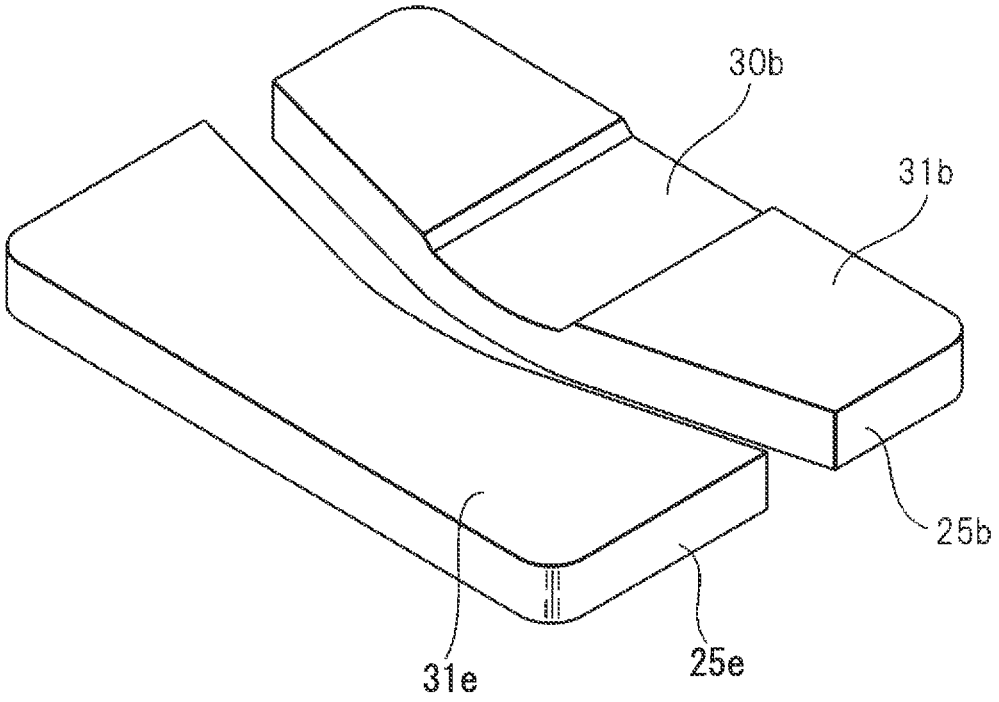
FIG. 8 is a view showing a wrinkle suppression mold of the press-forming tool according to the second embodiment and is a perspective view when viewed from a first surface side.

FIG. 8 is a perspective view of a wrinkle suppression mold of the press-forming tool according to the present embodiment when viewed from a first surface side.

A press-forming tool 2 of the present embodiment is the same as the press-forming tool 1 of the first embodiment except that only the wrinkle suppression force increasing portion 16*b* is provided on the plate 14, the pressure receiving portion 30*b* formed of a groove portion is disposed only on the wrinkle suppression mold 25*b*, and a wrinkle suppression mold 25*e* does not include the pressure receiving portion.

In the press-forming tool 2 according to the present embodiment, the wrinkle suppression force with respect to the blank material 5 can be increased only on the region (only the portion which is particularly added the increased wrinkle suppression force) in which the extension flange deformation occurs. That is to say, when the tensile strength of the blank material 5 is not so high, each of the pressure receiving portion 30*b* and the wrinkle suppression force increasing portion 16*b* may be disposed according to curvature or the like of the bent portion 52 of the press-formed product 50.

Figure 9A:
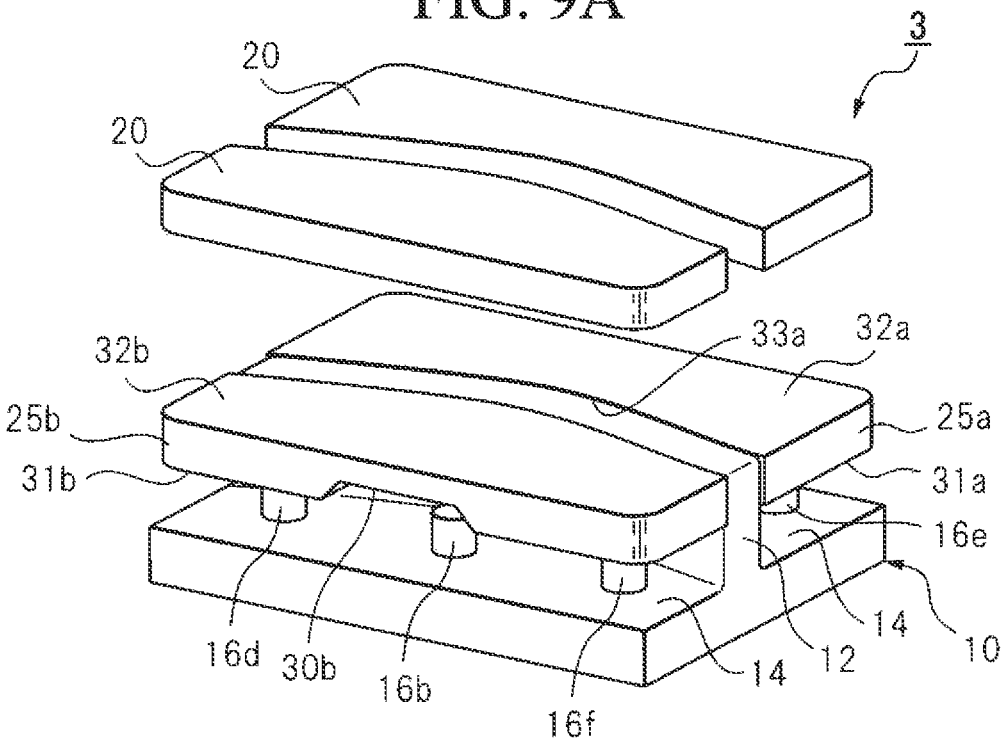
FIG. 9A is a view showing a schematic configuration of a press-forming tool according to a third embodiment of the present invention, and is a perspective view showing the entirety thereof.
Figure 9B:
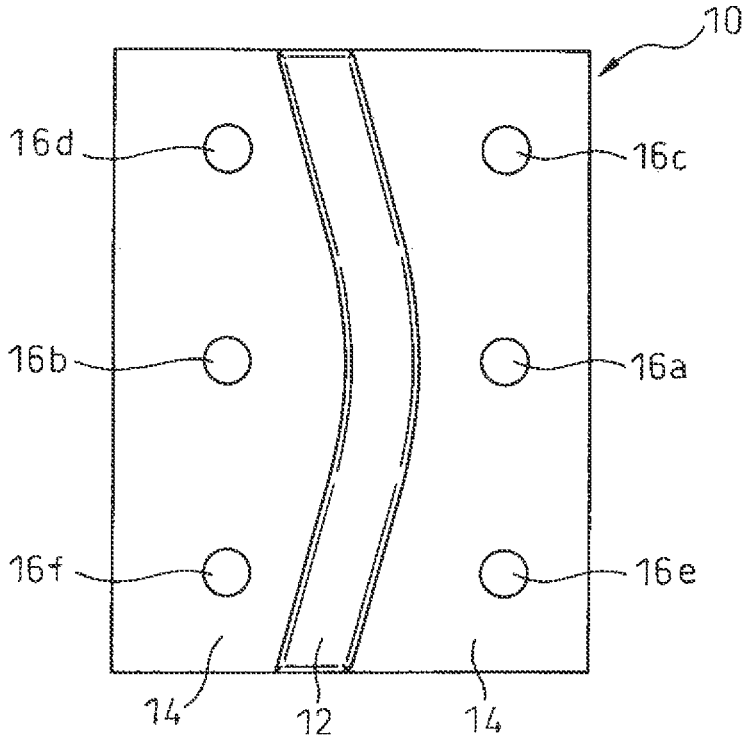
FIG. 9B is a plan view of a punch of the press-forming tool according to the third embodiment.

Next, a press-forming tool according to a third embodiment of the present invention will be described. FIGS. 9A and 9B are views showing a schematic configuration of the press-forming tool according to the third embodiment of the present invention. FIG. 9A is a perspective view showing the entirety thereof and FIG. 9B is a plan view of a punch configuring the press-forming tool.

A press-forming tool 3 according to the present embodiment is the same as the press-forming tool 1 according to the first embodiment except that wrinkle suppression force increasing portions 16*a*, 16*b*, 16*c*, 16*d*, 16*e*, and 16*f* are disposed on the plate portion 14.

Moreover, the wrinkle suppression molds 25*a* and 25*b* of the press-forming tool 3 according to the present embodiment shown in FIG. 9A are the same as the wrinkle suppression molds 25*a* and 25*b* of the press-forming tool 1 according to the first embodiment shown in FIG. 2.

As shown in FIGS. 9A and 9B, the press-forming tool 3 according to the present embodiment includes the wrinkle suppression force increasing portions 16*c* to 16*f* in addition to the wrinkle suppression force increasing portions 16*a* and 16*b* which come into contact with the pressure receiving portions 30*a* and 30*b* in the end phase of the press forming. Accordingly, it is possible to precisely control the wrinkle suppression force with respect to the blank material 5 in the end phase of the press forming.

However, compared to the wrinkle suppression force increasing portions 16*a* and 16*b* which come into contact with the pressure receiving portions 30*a* and 30*b*, in the wrinkle suppression force increasing portions 16*c* to 16*f* which come into contact with the first surfaces 31*a* and 31*b* not the pressure receiving portions 30*a* and 30*b*, the effect which is exerted by increasing the wrinkle suppression force with respect to the blank material 5 is smaller. That is to say, whether or not disposing the wrinkle suppression force increasing portions 16*c* to 16*f* which come into contact with the first surface 31*a* and 31*b*, which is not the pressure receiving portions 30*a* and 30*b*, may be determined according to the shape of the press-formed product or the structure of the press mold.

Figure 10A:
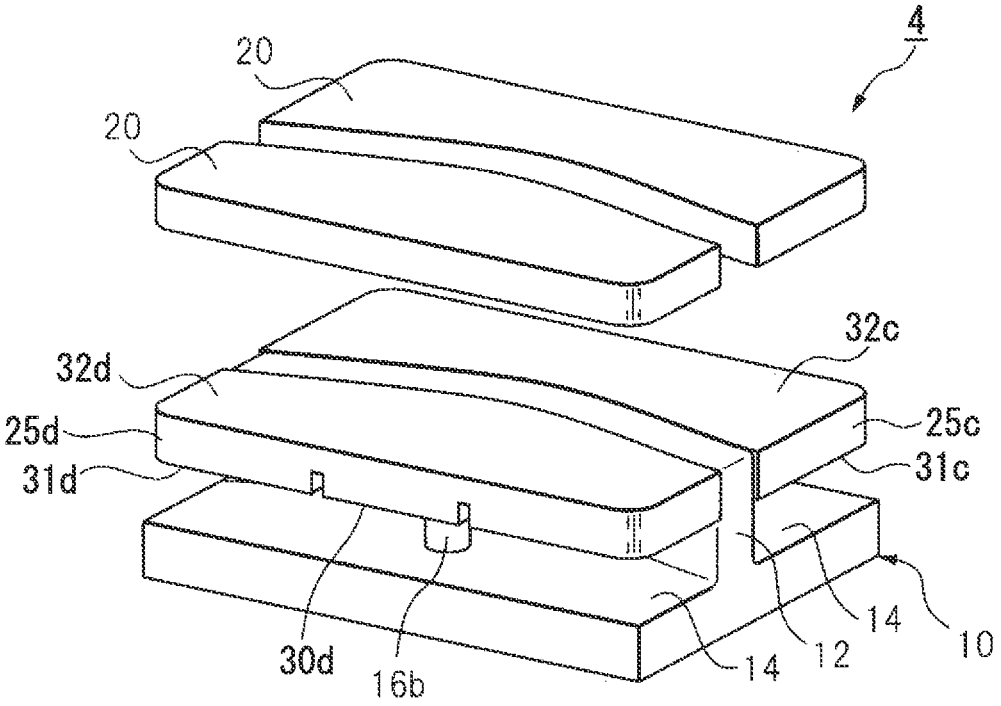
FIG. 10A is a view showing a schematic configuration of a press-forming tool according to a fourth embodiment of the present invention, and is a perspective view showing the entirety thereof.
Figure 10B:
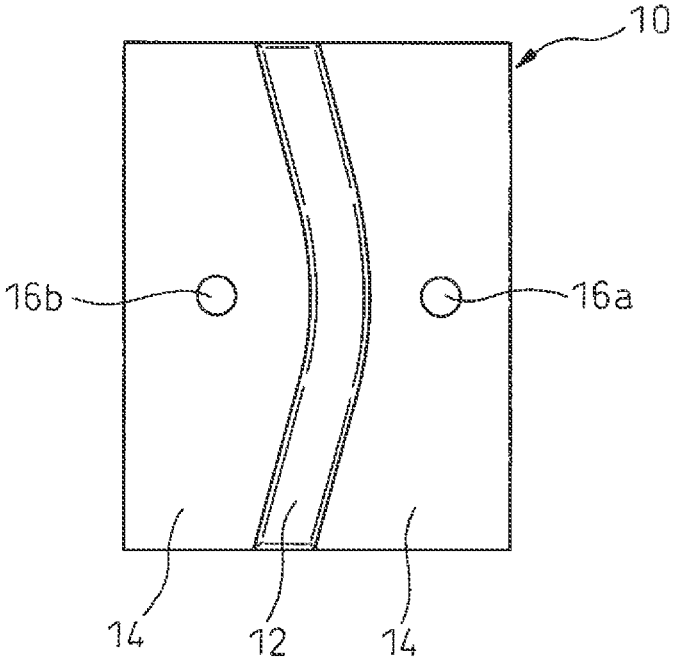
FIG. 10B is a plan view of a punch of the press-forming tool according to the fourth embodiment.

Next, a press-forming tool according to a fourth embodiment of the present invention will be described. FIGS. 10A and 10B are views showing a schematic configuration of the press-forming tool according to the fourth embodiment of the present invention. FIG. 1 OA is a perspective view showing the entirety thereof and FIG. 10B is a plan view of a punch configuring the press-forming tool.

Figure 11:
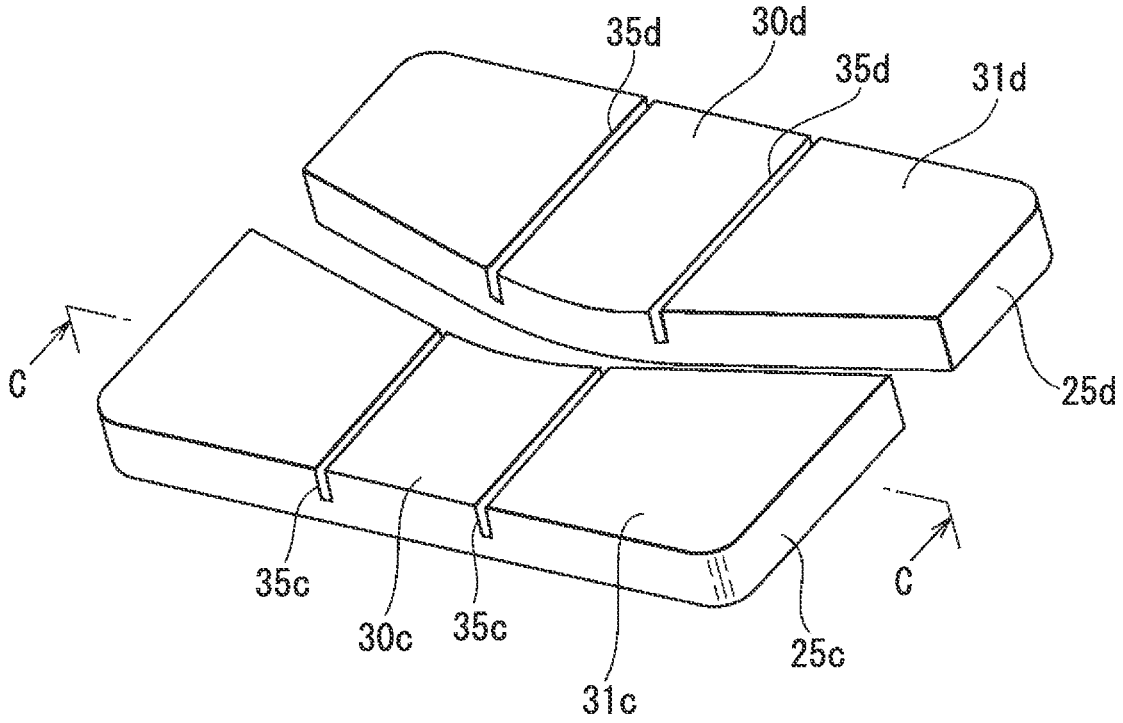
FIG. 11 is a view showing a wrinkle suppression mold of the press-forming tool according to the fourth embodiment and is a perspective view when viewed from a first surface side.
Figure 12:
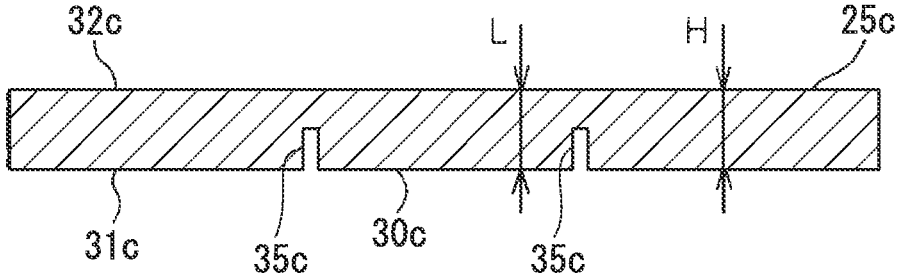
FIG. 12 is a vertical cross-sectional view when viewed in an arrow C direction shown in FIG. 11.

FIG. 11 is a perspective view when a wrinkle suppression mold of the press-forming tool according to the fourth embodiment is viewed from a first surface side. FIG. 12 is a view explaining the wrinkle suppression mold according to the present embodiment and is a vertical cross-sectional view of the wrinkle suppression mold when viewed from an arrow C direction shown in FIG. 11.

A press-forming tool 4 according to the present embodiment is the same as the press-forming tool 1 according to the first embodiment except that the pressure receiving portions 30*c* and 30*d* of the wrinkle suppression molds 25*c* and 25*d* include groove portions 35*c* and 35*d* and the groove portions 35*c* and 35*d*, become a portion of the boundary portion and partition the pressure receiving portions 30*c* and 30*d*.

In addition, the punch 10 according to the present embodiment shown in FIG. 10B is the same as the punch 10 according to the first embodiment.

The wrinkle suppression molds 25*c* and 25*d* according to the present embodiment are constituted of the minimum number of components which is difficult to divide it further, from the viewpoint of the structure of the press mold and the shape of the press-formed product. That is to say, the wrinkle suppression molds 25*c* and 25*d* are not split-type wrinkle suppression molds but integral-type wrinkle suppression molds.

The wrinkle suppression molds 25*c* and 25*d* include first surfaces 31*c* and 31*d* which oppose the plate portion 14 of the punch 10 and come into contact with the plate portion 14 at the press-forming ending point. In addition, the wrinkle suppression molds 25*c* and 25*d* includes second surfaces 32*c* and 32*d* which oppose the die 20 and hold the blank material 5 along with the die 20.

In the wrinkle suppression molds 25*c* and 25*d*, the pressure receiving portions 30*c* and 30*d* which receive the reaction force for elastically deforming the wrinkle suppression molds 25*c* and 25*d* in the end phase of the press forming are provided on the first surfaces 31*c* and 31*d*. The pressure receiving portions 30*c* and 30*d* include the groove portions 35*c* and 35*d*. The groove portions 35*c* and 35*d* become a portion of the boundary portion, and the pressure receiving portions 30*c* and 30*d* are partitioned on the first surfaces 31*c* and 31*d*.

Specifically, as shown in FIG. 11, the pressure receiving portions 30*c* and 30*d* are partitioned by the groove portions 35*c* and 35*d* and partial edges of the first surfaces 31*c* and 31*d* on the first surfaces 31*c* and 31*d*.

In the end phase of the press forming, the pressure receiving portions 30*c* and 30*d* and the wrinkle suppression force increasing portions 16*a* and 16*b* come into contact with each other, and thus, the wrinkle suppression molds 25*c* and 25*d* are elastically deformed. As a result, it is possible to locally add the wrinkle suppression force to the portion of the blank material 5 which is added the increased wrinkle suppression force.

Accordingly, the wrinkle suppression force in the shrinkage flange deformation region or the extension flange deformation region can be locally increased in the end phase of the press forming, and thus, it is possible to effectively suppress the springback.

In the end phase of the press forming, the wrinkle suppression molds 25*c* and 25*d* receive the reaction force from the wrinkle suppression force increasing portions 16*a* and 16*b* by the pressure receiving portions 30*c* and 30*d*, the wrinkle suppression molds 25*c* and 25*d* include the groove portions 35*c* and 35*d*. Accordingly, the reaction force is not distributed to the entire wrinkle suppression molds 25*c* and 25*d*.

If the wrinkle suppression molds 25*c* and 25*d* receive the reaction force from the wrinkle suppression force increasing portions 16*a* and 16*b*, the wrinkle suppression molds 25*c* and 25*d* are convexly and elastically deformed to the die 20 (blank material 5) side with the groove portions 35*c* and 35*d* as the boundary portion. As a result, it is possible to locally and intensively increase the wrinkle suppression force with respect to the blank material 5.

The depths, widths, or the like of the groove portions 35*c* and 35*d* of the present embodiment are not particularly limited. The groove portions 35*c* and 35*d* may have appropriate dimensions according to the shape of the press-formed product 50 and the structure of the press mold 4. The thickness L of each of the wrinkle suppression mold 25*c* and 25*d* in the pressure receiving portions 30*c* and 30*d* excluding the groove portions 35*c* and 35*d*, and the thickness H of each of the wrinkle suppression mold 25*c* and 25*d* in the region which excludes the pressure receiving portions 30*c* and 30*d* and comes into contact with the blank material 5 are not particularly limited.

In the present embodiment, although it is shown that the aspect in which the thickness L and the thickness H are the same as each other, it is sufficient that the thickness L is $20 \leq L \leq H$. Moreover, if the thickness L satisfies $20 \leq L \leq H$, similar to the first embodiment, it is sufficient that the protruding height G of each of the wrinkle suppression force increasing portions 16*a* and 16*b* is $0.02 \times PS + H - L \leq G \leq 0.3 \times PS + H - L$.

The press-forming tools 1 to 4 according to the first to fourth embodiments of the present invention are described above. Next, effective positions to dispose the wrinkle suppression force increasing portions 16*a* to 16*f* and the pressure receiving portions 30*a* to 30*d* will be described.

Figure 13A:
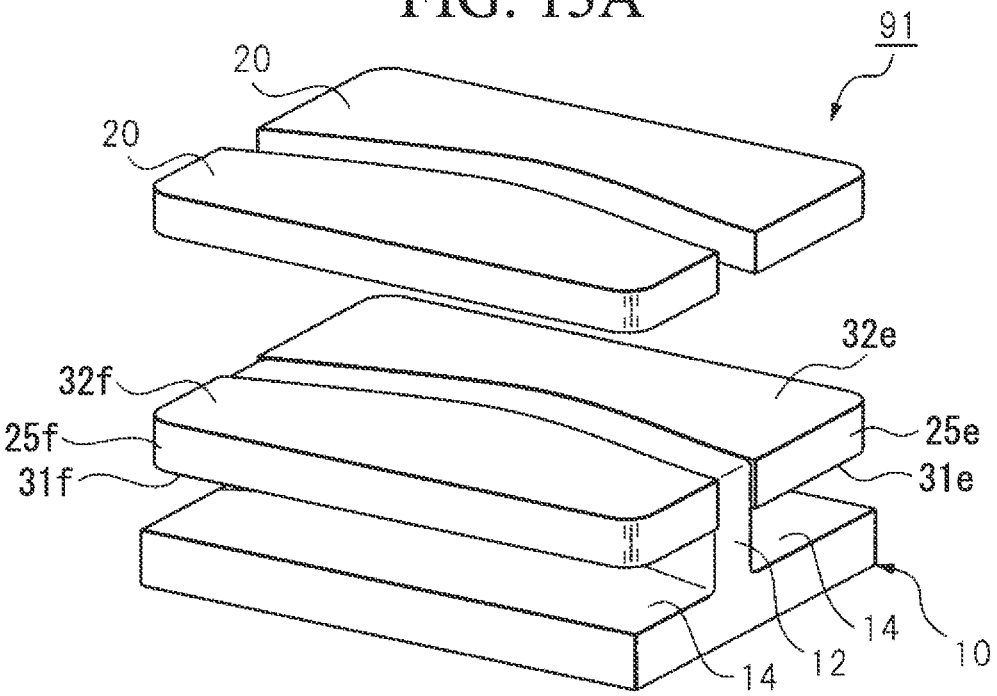
FIG. 13A is a view showing a schematic configuration of a press-forming tool of the related art which does not include a pressure receiving portion and a wrinkle suppression force increasing portion and is a perspective view showing the entirety thereof.
Figure 13B:
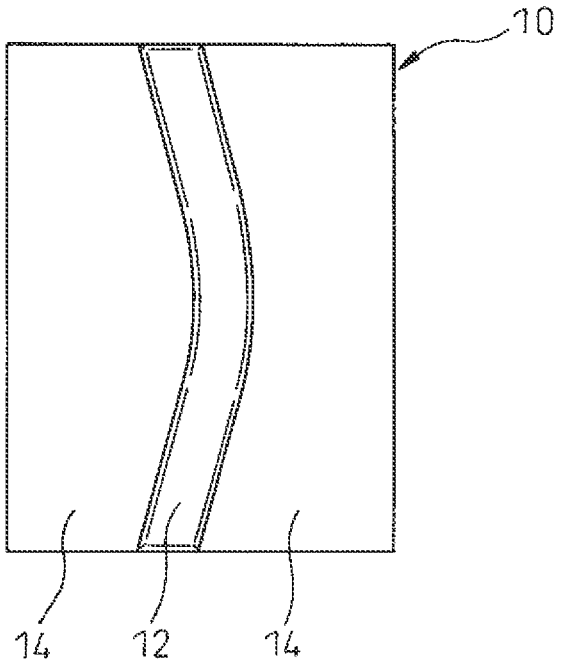
FIG. 13B is a plan view showing a punch of the press-forming tool of the related art which does not include the pressure receiving portion and the wrinkle suppression force increasing portion.

FIGS. 13A and 13B are views showing a schematic configuration of a press-forming tool of the related art which does not include the pressure receiving portion and the wrinkle suppression force increasing portion. FIG. 13A is a perspective view showing the entirety thereof, and FIG. 13B is a plan view showing a punch configuring the press-forming tool of the related art. In FIG. 13A, a reference numeral 91 indicates the press-forming tool of the related art.

Figure 14:
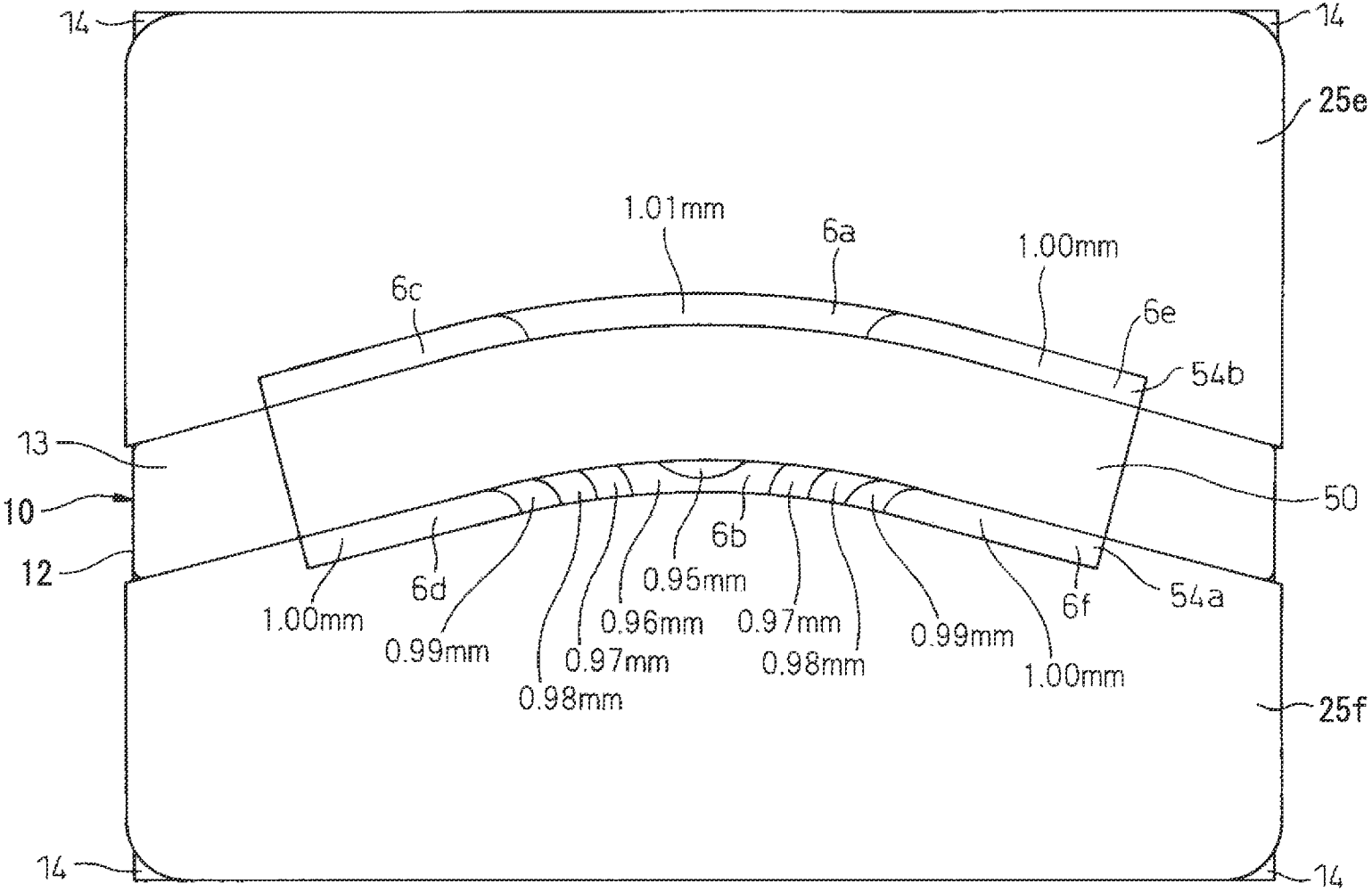
FIG. 14 is an explanatory view showing a plate thickness distribution of a flange portion in a press-formed product which is formed by the press-forming tool of the related art shown in FIG. 13A.

FIG. 14 is an explanatory view showing a plate thickness distribution of a flange portion in a press-formed product when the blank material 5 having the plate thickness of 1.0 mm is performed drawing and bending processing (press-forming) using the press-forming tool of the related art shown in FIG. 13A.

That is to say, FIG. 14 is a view showing the state of the press-formed product 50 after the blank material 5 is performed drawing and bending processing (press-forming) using the press-forming tool 91 shown in FIG. 13A, and is plan view when viewed along the pressing direction in a state where the die 20 is omitted.

In FIG. 14, the measurement results of the plate thickness of the flange portions 54*a* and 54*b* are shown. As shown in FIG. 14, the flange portions 54*a* and 54*b* include a curved outside portion 6*a*, a curved inside portion 6*b*, and straight line portions 6*c*, 6*d*, 6*e*, and 6*f*.

As shown in FIG. 14, the plate thickness of the curved outside portion 6*a* is thick. The curved outside portion 6*a* becomes a plate thickness maximum portion in which the plate thickness is the maximum in the flange portions 54*a* and 54*b* of the press-formed product 50. On the other hand, the plate thickness of the curved inside portion 6*b* is thin.

In this way, in the press-formed product 50 which is press-formed using the press-forming tool 91 of the related art, the plate thicknesses in respective portions in the flange portions 54*a* and 54*b* are not the same as one another. The second surfaces 32*e* and 32*f* of wrinkle suppression molds 25*e* and 25*f* and the die 20 which hold the blank material 5 are flat.

Accordingly, in the wrinkle suppression mold 91 in which the pressure receiving portions 30*a* to 30*d* are not provided like the wrinkle suppression molds 25*e* and 25*f*, when the plate thickness of each position in the flange portions 54*a* and 54*b* is changed during the press forming, a portion to which the wrinkle suppression force is strongly applied and a portion to which the wrinkle suppression force is weakly applied exist.

If the magnitude of the wrinkle suppression force is changed according to the portion during the press forming, a balance in the plastic flow of the blank material 5 during the plastic deformation is lost. As a result, dimension accuracy of the press-formed product 50 after the press forming is decreased.

In order to suppress the decrease in the dimension accuracy of the press-formed product 50 due to the above-described coexistence of the portion to which the wrinkle suppression force is strongly applied and the portion to which the wrinkle suppression force is weakly applied, it is preferable to increase the wrinkle suppression force at the portion at which the plate thickness in the flange portions 54*a* and 54*b* is decreased during the press forming, in the end phase of the press forming.

Specifically, the press-forming tool 91 of the related art in which the pressure receiving portions 30*a* to 30*d* and the wrinkle suppression force increasing portions 16*a* to 16*f* are removed from the press-forming tools 1 to 4 is set as a reference. A region in which the plate thickness becomes the maximum in the flange portions 54*a* and 54*b* of the press-formed product 50 is defined as a plate thickness maximum portion, and a region in which the plate thickness is more than 0% and less than or equal to 97% with respect to the plate thickness maximum portion is defined as a plate thickness decreasing portion. In this case, when viewed along the pressing direction, the pressure receiving portions 30*a* to 30*d* of the wrinkle suppression molds 25*a* to 25*d* are preferably disposed to overlap with a portion of the plate thickness decreasing portion on the blank material 5.

As a result, the wrinkle suppression force at the portion at which the plate thickness in the flange portions 54*a* and 54*b* is decreased during the press forming can be preferably increased in the end phase of the press forming. The wrinkle suppression force on the plate thickness decreasing portion, in which the plate thickness is more than 0% and less than or equal to 97% with respect to the plate thickness maximum portion, is preferably increased in the end phase of the press forming, and thus, the springback of the press-formed product 50 can be effectively decreased.

Figure 15:
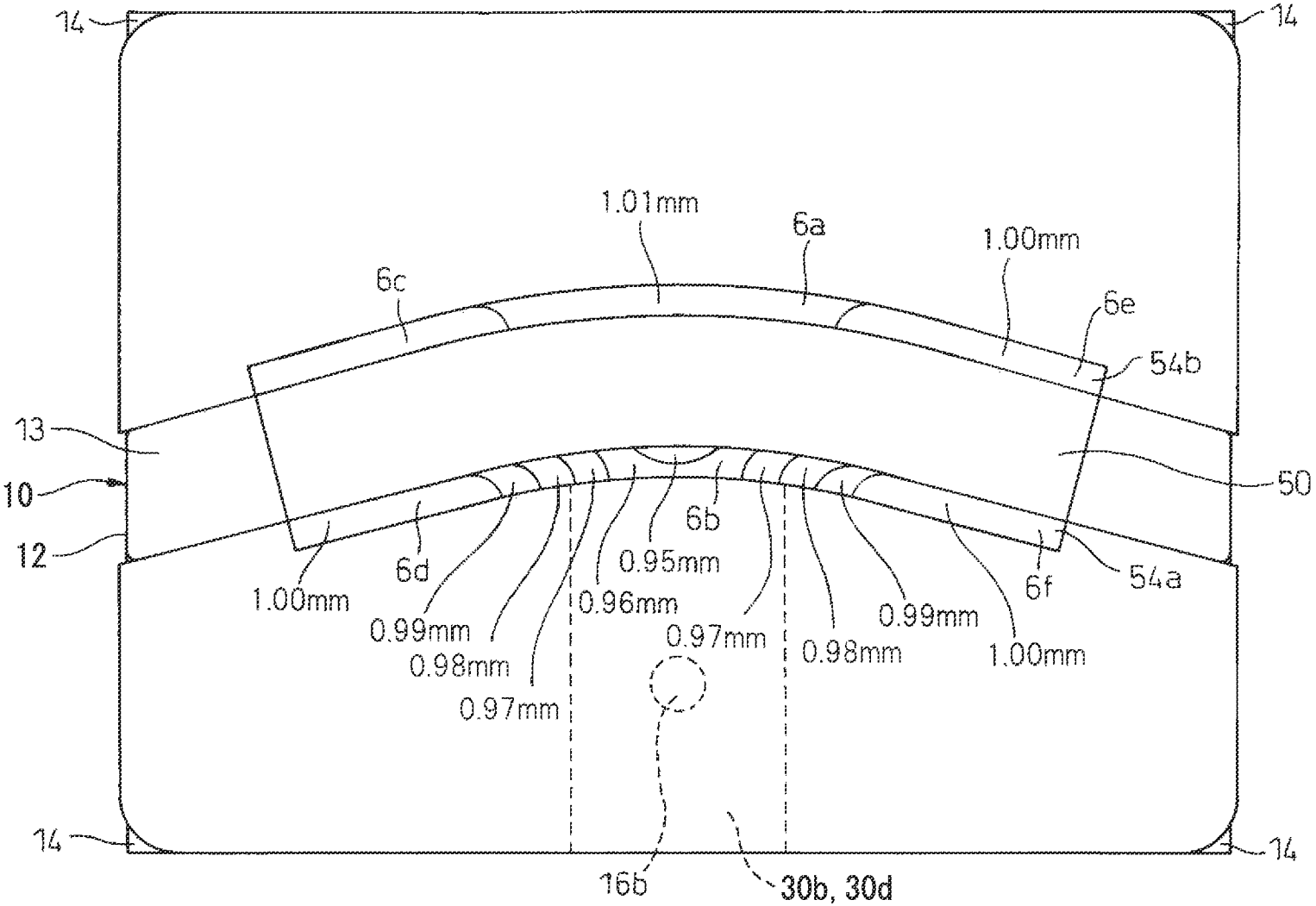
FIG. 15 is an explanatory view exemplifying positions at which the pressure receiving portion and the wrinkle suppression force increasing portion are disposed in the view showing the plate thickness distribution of the flange portion in the press-formed product which is formed by the press-forming tool of the related art shown in FIG. 13A.

FIG. 15 is an explanatory view exemplifying preferable positions at which the pressure receiving portion and the wrinkle suppression force increasing portion are disposed in the view showing the plate thickness distribution of the flange portion in the press-formed product which is formed by the press-forming tool of the related art shown in FIG. 13A. That is to say, as an example, FIG. 15 is an explanatory view in which the disposition positions of the pressure receiving portions 30*b* and 30*d* and the wrinkle suppression force increasing portion 16*b* are overlapped in FIG. 14.

As shown in FIG. 15, the pressure receiving portions 30*b* and 30*d* are preferably disposed so that a portion of the curved inside portion 6*b* (the portion which becomes the plate thickness decreasing portion having the plate thickness of more than 0% and less than or more than 97% with respect to the plate thickness maximum portion) overlaps with the curved outside portion 6*a* (the portion which becomes the plate thickness maximum portion in the flange portions 54*a* and 54*b* of the press-formed product 50 press-formed by the press-forming tool 91 of the related art).

The wrinkle suppression force increasing portion 16*b* is preferably disposed such that the wrinkle suppression force increasing portion 16*b* protrudes toward the pressure receiving portions 30*b* and 30*d*, and generate the reaction force opposite to the pressing direction when the wrinkle suppression force increasing portion is pressed in the pressing direction, and elastically deform the wrinkle suppression molds 25*b* and 25*d*.

As a result, it is possible to preferably increase the wrinkle suppression force of the curved inside portion 6*b* in which the plate thickness is decreased in the flange portions 54*a* and 54*b* during the press forming, in the end phase of the press forming.

In this way, by disposing the pressure receiving portions 30*b* and 30*d* and the wrinkle suppression force increasing portions 16*b*, the wrinkle suppression molds 25*b* and 25*d* are convexly and elastically deformed to the blank material 5 side by the pressure receiving portions 30*b* and 30*d* in the end phase of the press forming, and thus, it is possible to locally and intensively increase the wrinkle suppression force on the curved inside portion 6*b*.

The press-forming tools according to each aspect of the present invention described above are summarized as follows.

(1) The press-forming tools 1 to 4 according to each aspect of the present invention include the punch 10 which includes the punch portion 12 and the plate portion 14 configured to transfer a shape to the blank material 5, the die 20 which is paired with the punch 10 and opposes the punch portion 12, and wrinkle suppression molds 25*a* to 25*d*.

The wrinkle suppression molds 25*a* to 25*d* include the first surfaces 31*a* to 31*d*, the second surfaces 32*a* to 32*d*, and the side surfaces (third surfaces) 33*a* and 33*b* which are continuous between the first surface 31*a* to 31*d* and the second surface 32*a* to 32*d* and which oppose the punch portion 12. The wrinkle suppression molds 25*a* to 25*d* are disposed between the side surfaces (third surfaces) 33*a* and 33*b* and the punch portion 12 via a gap.

The first surfaces 31*a* to 31*d* oppose the plate portion 14 and come into contact with the plate portion 14 at the press-forming ending point. The second surfaces 32*a* to 32*d* oppose the die 20 and hold the blank material 5 along with the die 20.

The press-forming tools 1 to 4 according to each aspect of the present invention include: pressure receiving portions 30*a* to 30*d* which include the groove portion, which receives the reaction force to elastically deform the wrinkle suppression molds 25*a* to 25*d* in the end phase of the press forming, on the first surfaces 31*a* to 31*d* of the wrinkle suppression molds 25*a* to 25*d*; and wrinkle suppression force increasing portions 16*a* and 16*b* which are disposed on surfaces opposing the first surfaces 31*a* to 31*d* of the plate portion 14, protrude toward the pressure receiving portions 30*a* to 30*d*, and generate the reaction force in a direction opposite to the pressing direction when the wrinkle suppression force increasing portions are pressed in the pressing direction in the end phase of press forming.

(2) Based on a case where the pressure receiving portions 30*a* to 30*d* and the wrinkle suppression force increasing portions 16*a* and 16*b* are removed from the press-forming tools 1 to 4, the region in which the plate thickness is maximum in the flange portions 54*a* and 54*b* of the press-formed product 50 is defined as the plate thickness maximum portion. The region in which the plate thickness is more than 0% and less than and equal to 97% with respect to the plate thickness maximum portion is defined as the plate thickness decreasing portion. In this case, the pressure receiving portion 30*a* to 30*d* may overlap with a portion of the region corresponding to the plate thickness decreasing portion in the blank material 5 when viewed along the pressing direction.

(3) The pressure receiving portions 30*a* and 30*b* is constituted of a groove portion, the thickness of each of the wrinkle suppression molds 25*a* and 25*b* in the positions of the pressure receiving portions (groove portions) 30*a* and 30*b* is defined as L in mm units. The minimum value of the thickness of each of the wrinkle suppression molds 25*a* and 25*b* in the position which excludes the pressure receiving portions (groove portions) 30*a* and 30*b* and comes into contact with the blank material 5 is defined as H in mm units. In this case, each of the wrinkle suppression molds 25*a* and 25*b* may satisfy the following Expressions 1 and 2, and when the protruding height of each of the wrinkle suppression force increasing portions 16*a* and 16*b* from the surface of the plate portion 14 is defined as G in mm units and the press stroke distance from the press-forming starting point to the press-forming ending point is defined as PS in mm units, the protruding height G of each of the wrinkle suppression force increasing portions 16*a* and 16*b* may satisfy the following Expression 3.

$$20 \leq L \leq 0.8 \times H \text{ when } 40 \leq H \leq 50 \quad \text{(Expression 1)}$$

$$20 \leq L \leq 40 \text{ when } 50 < H \leq 80 \quad \text{(Expression 2)}$$

$$0.02 \times PS + H - L \leq G \leq 0.3 \times PS + H - L \quad \text{(Expression 3)}$$

(4) A portion of the boundary which partitions the pressure receiving portions 30*c* and 30*d* may be the groove portions 35*c* and 35*d*. Specifically, the pressure receiving portions 30*c* and 30*d* may include the groove portions 35*c* and 35*d*, the groove portions 35*c* and 35*d* become a portion of the boundary portion, and thus, the pressure receiving portions 30*c* and 30*d* may be partitioned on the first surfaces 31*c* and 31*d*.

(5) The wrinkle suppression force increasing portions 16*a* and 16*b* may include an elastic body which applies the reaction force.

(6) The elastic body may be at least one of the disc spring 42*a*, a helical spring, and rubber.

Next, a method for manufacturing the press-formed product 50 which is press-formed using the press-forming tools 1 to 4 according to the embodiments of the present invention will be described.

A method for manufacturing the press-formed product 50 according to an aspect of the present invention, including: a step of increasing the wrinkle suppression force with respect to a portion of the blank material 5 during the press forming in the end phase of the press forming from the position at which the press stroke is 2% to 30% to the forming end position using the press-forming tools 1 to 4 according the above-described aspects, and when the forming start position of the press stroke when the blank material 5 is press-formed is defined as 100% and the forming end position of the press stroke is defined as 0%.

According to the method of manufacturing the press-formed product 50, the springback is suppressed, and thus, the press-formed product 50 having high dimension accuracy can be obtained. In the method for manufacturing, if the position of the press stroke which is a starting position of increasing the wrinkle suppression force is less than 2%, the increase in the wrinkle suppression force is not sufficient, and thus, the effect which is exerted by decreasing the springback may be unstable.

On the other hand, if the position of the press stroke which is a starting position of increasing the wrinkle suppression force is more than 30%, the interval of increasing the wrinkle suppression force becomes too long. Accordingly, the difference in the wrinkle suppression force is decreased between the forming starting position of the press stroke and the forming ending position of the press stork.

Therefore, the effect which is exerted by increasing the wrinkle suppression force only in the end phase of the press forming is decreased, and thus, the springback may occur to the contrary. Moreover, in order to further decrease the springback, the position of the press stroke which is a starting position of increasing the wrinkle suppression force is preferably 5% to 15%.

EXAMPLE 1

Effects of the aspects of the present invention will be further described according to Examples. However, conditions of Examples are conditions adopted to confirm feasibility and effects of the present invention, and the present invention is not limited to the conditions. The present invention adopts various conditions if achieving the object of the present invention without departing from the gist of the present invention.

EXAMPLE 1

The blank material 5 was obtained by laser-cutting the high tensile strength steel sheet in a predetermined shape. The blank material 5 was performed drawing and bending processing (press-forming) so that the shape became a hat-shaped cross section. Moreover, after the drawing and bending processing, the blank material was performed finishing processing (restriking processing). Conditions or the like for each process are described below.

Figure 16A:
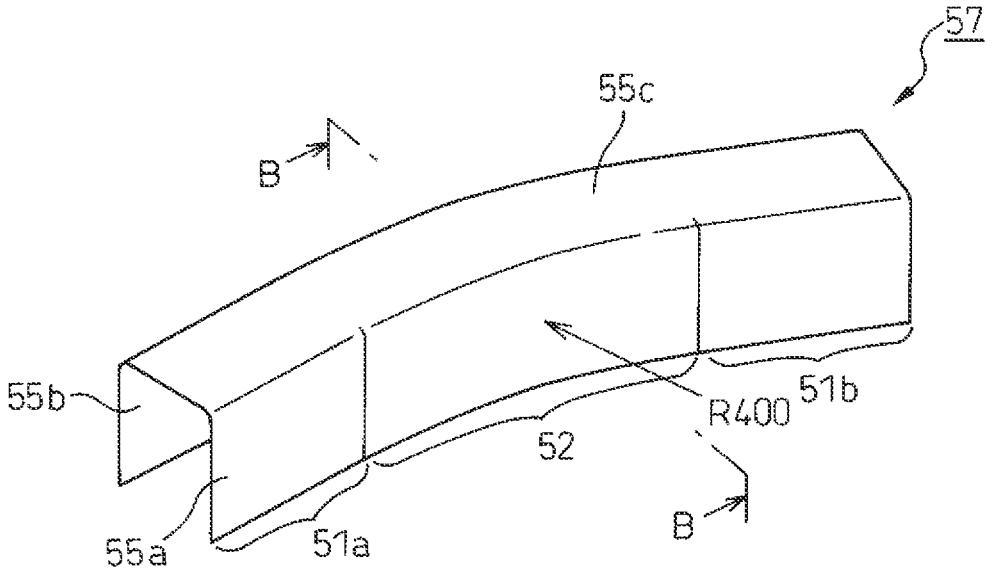
FIG. 16A is a perspective view showing the press-formed product after the finishing processing (restriking processing).
Figure 16B:
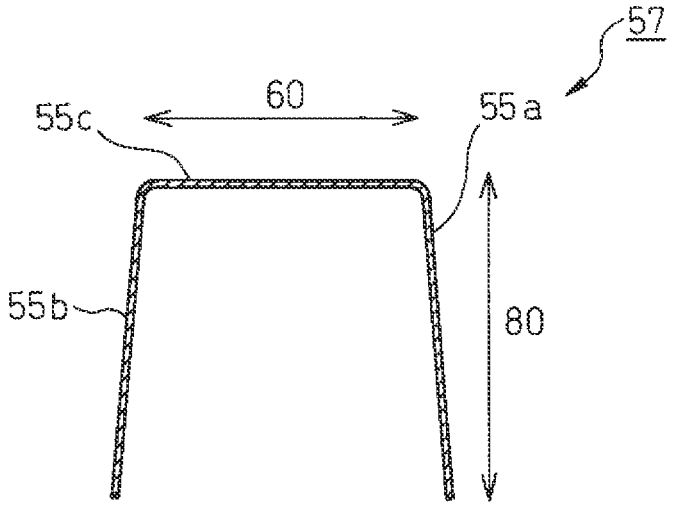
FIG. 16B is a vertical cross-sectional view when viewed from an arrow B direction in FIG. 16A.

The high tensile strength steel sheet having 1.0 mm in the plate thickness and 590 MPa in the tensile strength was used as the material, the high tensile strength steel sheet was laser-cut so that the shape after the finishing processing (restriking processing) became a cross-section width of 60 mm and a height of 80 mm as shown in FIGS. 16A and 16B, and thus, the blank material 5 was obtained.

The blank material 5 was performed drawing and bending processing (press-forming) to have the shape (hat-shaped cross section) shown in FIGS. 6A and 6B using the press-forming tool 1 FIGS. 1A to 2 (the press-forming tool 1 according to the first embodiment), the press-forming tool 2 shown in FIGS. 7A to 8 (the press-forming tool 2 according to the second embodiment), and the press-forming tool 3 shown in FIGS. 9A and 9B (the press-forming tool 3 according to the third embodiment).

As the wrinkle suppression force increasing portions 16*a* to 16*f*, the disc spring unit which is a combination of disc springs 42*a* shown in FIG. 4A was used. The load (reaction force) to which the wrinkle suppression force increasing portions 16*a* to 16*f* were applied to the wrinkle suppression molds 25*a* and 25*b* in the end phase of the press forming and were changed according to the number and the combination method (parallel, series, and parallel series) of the disc springs 42*a*.

In the press-forming tool 3 (the press-forming tool 3 according to the third embodiment) shown in FIGS. 9A and 9B, in addition to the pressure receiving portions 30*a* and 30*b*, the wrinkle suppression force increasing portions 16*c* to 16*f* were disposed.

The thicknesses H of the wrinkle suppression molds 25*a* and 25*b* on the region which exclude the pressure receiving portions 30*a* and 30*b* and come into contact with the blank material 5, the thicknesses L of the wrinkle suppression molds 25*a* and 25*b* on the pressure receiving portion 30*a* and 30*b*, and the thickness ratio L/H are shown in Table 1.

The load (reaction force) of the wrinkle suppression force increasing portions 16*a* to 16*f* applied to the wrinkle suppression molds 25*a* and 25*b* are also shown in Table 1. The load is indicated in the total value of the loads of the disc spring unit disposed on the press-forming tools 1 to 3.

For example, the press-forming tool 3 shown in FIGS. 9A and 9B was used in the Example of the present invention No. 6. In this case, six wrinkle suppression force increasing portions 16*a* to 16*f* are disposed. The load (reaction force) which is applied to the wrinkle suppression molds 25*a* and 25*b* by one disc spring unit in the wrinkle suppression force increasing portions 16*a* to 16*f* is 100 kN. Accordingly, the total of the loads (reaction forces) is 600 kN (100 kN×6).

In Conventional Example No. 14, the press-forming tool 91 shown in FIGS. 13A and 13B, which did not have the pressure receiving portions 30*a* and 30*b* and the wrinkle suppression force increasing portions 16*a* to 16*f*, was used. In Reference Example 1, the press-forming tool 1 in which the thickness H and the thickness L of the wrinkle suppression molds 25*a* and 25*b* were the same as each other was used.

That is to say, the press-forming tool 1 used in the Reference Example 1 was a press-forming tool in which the wrinkle suppression molds 25*e* and 25*f* which did not have the pressure receiving portion and the punch 10 which had the wrinkle suppression force increasing portions 16*a* and 16*b* were combined.

wrinkle suppression load (total value of the loads applied to the wrinkle suppression molds 25*a* and 25*b*) was applied. Conventional Example No. 14 was also performed similarly.

The press forming apparatus used was a general press forming apparatus which did not have a variable die cushion device or the like.

In No. 1 to No. 10 in the Examples of the present invention and the Reference Examples, the increase in the wrinkle suppression force in the end phase of the press forming started from the height of 9 mm before the press-forming ending point. That is to say, the protruding height G of each of the wrinkle suppression force increasing portions 16*a* and 16*b* coming into contact with the pressure receiving portions 30*a* and 30*b* in the end phase of the press forming was set to the value which added 9 mm to the depth (H-L) of each of the pressure receiving portions 30*a* and 30*b*.

The press stroke distance PS from the press-forming starting point to the press-forming ending point was 60 mm. That is to say, when the forming start position of the press stroke was defined as 100% and the forming end position of the press stroke was defined as 0% during the press-forming of the blank materials, the position of the press stroke which is a starting position of increasing the wrinkle suppression force was positioned at the position of 15%.

Here, the wrinkle suppression force increasing portions 16*a* and 16*b* coming into contact with the pressure receiving portions 30*a* and 30*b* in the end phase of the press forming

TABLE 1

| No. | Reference Figure | Pressure receiving portion | Wrinkle suppression force increasing portion Position | Wrinkle suppression force increasing portion Load (kN) | Protrusion height G (mm) | Thickness H (mm) | Thickness L (mm) | L/H (%) | Press stroke position which is added increased wrinkle suppression force (%) | Remark |
|---|---|---|---|---|---|---|---|---|---|---|
| 1 | FIGS. 1A to 2 | — | 16a, 16b | 200 (100 × 2) | 9 | 50 | 50 | 100 | 15 | Reference Example |
| 2 | FIGS. 1A to 2 | 30a, 30b | 16a, 16b | 200 (100 × 2) | 14 | 50 | 45 | 90 | 15 | Reference Example |
| 3 | FIGS. 1A to 2 | 30a, 30b | 16a, 16b | 200 (100 × 2) | 19 | 50 | 40 | 80 | 15 | Example |
| 4 | FIGS. 1A to 2 | 30a, 30b | 16a, 16b | 200 (100 × 2) | 24 | 50 | 35 | 70 | 15 | Example |
| 5 | FIGS. 7A to 8 | 30b | 16b | 100 (100 × 1) | 19 | 50 | 40 | 80 | 15 | Example |
| 6 | FIG. 9A and 9B | 30a, 30b | 16a, 16b, 16c 16d, 16e, 16f | 600 (100 × 6) | 19 | 50 | 40 | 80 | 15 | Example |
| 7 | FIG. 7A to 8 | 30b | 16b | 100 (100 × 1) | 21 | 40 | 28 | 70 | 15 | Example |
| 8 | FIG. 7A to 8 | 30b | 16b | 100 (100 × 1) | 30 | 70 | 49 | 70 | 15 | Reference Example |
| 9 | FIG. 7A to 8 | 30b | 16b | 100 (100 × 1) | 39 | 70 | 40 | 57 | 15 | Example |
| 10 | FIG. 7A to 8 | 30b | 16b | 100 (100 × 1) | 34 | 60 | 35 | 58 | 15 | Example |
| 11 | FIG. 1A to 2 | 30a, 30b | 16a, 16b | 200 (100 × 2) | 35 | 50 | 35 | 70 | 33 | Example |
| 12 | FIG. 1A to 2 | 30a, 30b | 16a, 16b | 200 (100 × 2) | 16.5 | 50 | 35 | 70 | 2.5 | Example |
| 13 | FIG. 1A to 2 | 30a, 30b | 16a, 16b | 200 (100 × 2) | 16.1 | 50 | 35 | 70 | 1.8 | Reference Example |
| 14 | FIG. 13A and 13B | — | — | — | — | 50 | 50 | 100 | 0 | Conventional Example |

The drawing and bending processing (press forming) was performed using a press forming apparatus having a capability of 1960 kN (200 tons). Press forming was performed until the height of the press-formed product 50 became 60 mm as shown in FIG. 6B while 196 kN (20 tons) in the is described. However, in the wrinkle suppression force increasing portions 16*c* to 16*f* which did not come into contact with the pressure receiving portions 30*a* and 30*b* in the end phase of the press forming, the protruding height G was set to 9 mm.

In No. 11 to No. 13 in the Examples of the present invention and the Reference Examples, the increase in the wrinkle suppression force in the end phase of the press forming was controlled as follows. That is to say, as shown in Table 1, the starting position of increasing the wrinkle suppression force was controlled by setting the depth (H-L) of each of the pressure receiving portions 30*a* and 30*b* to be constant and changing the value of the protruding height G.

In Example No. 11 of the present invention, the increase in the wrinkle suppression force started from the height (the position in which the press stroke is 33%) of 20 mm before the press-forming ending point. In Example No. 12 of the present invention, the increase in the wrinkle suppression force started from the height (the position in which the press stroke is 2.5%) of 1.5 mm before the press-forming ending point. In Example No. 13 of the present invention, the increase in the wrinkle suppression force started from the height (the position in which the press stroke is 1.8%) of 1.1 mm before the press-forming ending point.

The finishing processing (restriking processing) was performed using the press-formed product 50 obtained by the above-described drawing and bending processing (press forming).

FIGS. 16A and 16B are views showing the press-formed product after the finishing processing (restriking processing). FIG. 16A is a perspective view and FIG. 16B is a vertical cross-sectional view when viewed from an arrow B direction in FIG. 16A. In FIGS. 16A and 16B, a reference numeral 57 indicates the press-formed product after the finishing processing (restriking processing).

Figure 17:
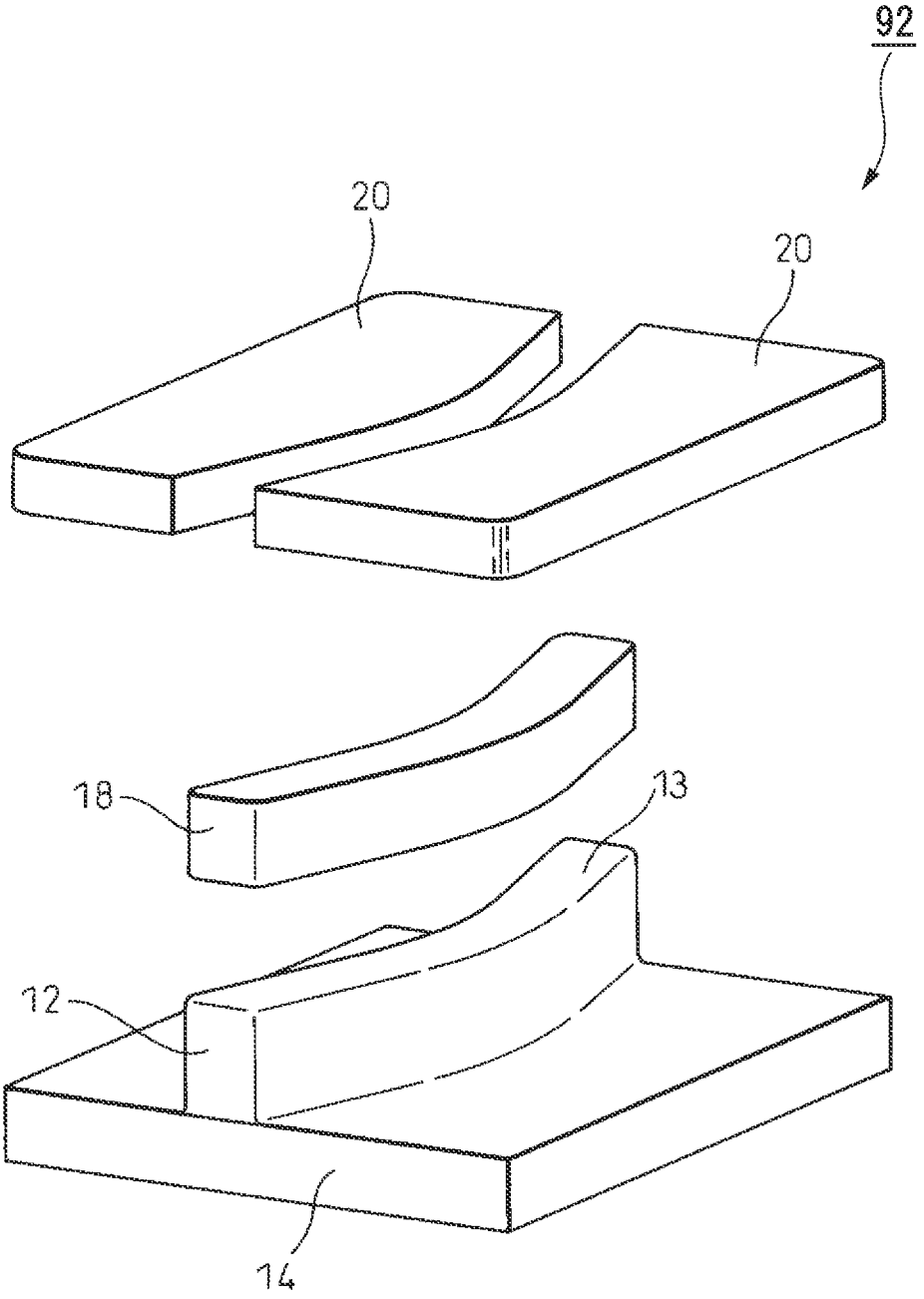
FIG. 17 is a view showing a schematic configuration of a restriking processing mold performing the finishing processing (restriking processing) and is a perspective view showing the entirety thereof.

FIG. 17 is a view showing a schematic configuration of a restriking processing mold which performs the finishing processing (restriking processing) and is a perspective view showing the entirety thereof. In FIG. 17, a reference numeral 92 indicates the restriking processing mold.

In the press-formed product 50 obtained by the drawing and bending processing (press forming), a hat portion surrounded by the vertical wall portions 55*a* and 55*b* and the top portion 55*c* was fitted into the punch portion 12 of the restriking processing mold 92, and the top portion 55*c* was pressed by a pad 18. The finishing processing (restriking processing) was performed by the punch portion 12 and the die 20. In the finishing processing (restriking processing), the wrinkle suppression was not performed.

The finishing processing (restriking processing) was performed using a press-forming apparatus having a capability of 1960 kN (200 tons). As shown in FIG. 16B, the restriking processing was performed until the height of the press-formed product 57 was 80 mm as shown in FIG. 16B. According to the finishing processing (restriking processing), the press-formed product 50 having the hat-shaped cross section became the press-formed product 57 having the shape shown in FIGS. 16A and 16B.

The press-forming apparatus used was a general press-forming apparatus which did not include the variable die cushion device or the like.

Next, an evaluation method of the springback with respect to the press-formed product 50 after the drawing and bending processing and the press-formed product after the finishing processing (restriking processing) 57 will be described.

Figure 18:
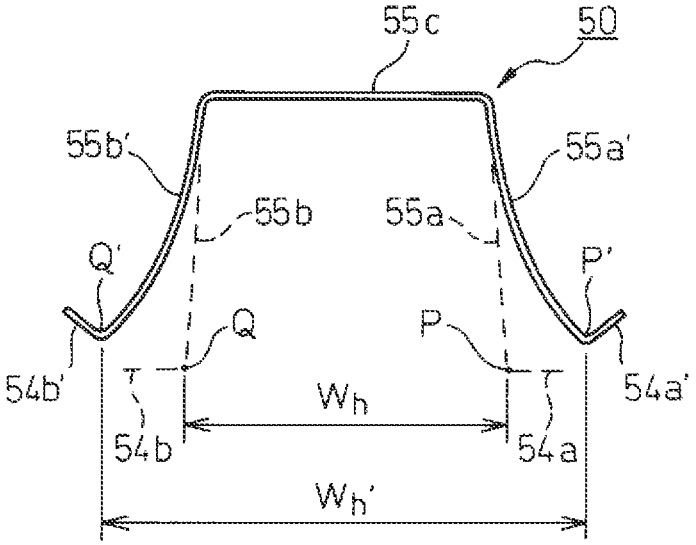
FIG. 18 is a vertical cross-sectional view perpendicular to a longitudinal direction of the press-formed product which is performed drawing and bending processing, and an explanatory view showing a generation state of wall warpage (springback).

FIG. 18 is a vertical cross-sectional view perpendicular to a longitudinal direction of the press-formed product after the drawing and bending processing, and an explanatory view showing a generation state of wall warpage (springback). In FIG. 18, $W_h$ indicates the gap between the vertical wall portion 55*a* and the vertical wall portion 55*b* when the springback is not generated. $W_h'$ indicates the gap between the vertical wall portion 55*a*' and the vertical wall portion 55*b*' when the springback is generated. $\Delta W_h$ indicates the difference between $W_h'$ and $W_h$.

Specifically, as shown in FIG. 18, when an intersection point of the vertical wall portion 55*a* and the flange portion 54*a* is defined as P and an intersection point of the vertical wall portion 55*b* and the flange portion 54*b* is defined as Q, a line segment PQ is defined as $W_h$. Moreover, when an intersection point of the vertical wall portion 55*a*' and the flange portion 54*a*' is defined as P' and an intersection point of the vertical wall portion 55*b*' and the flange portion 54*b*' is defined as Q', a line segment P'Q' is defined as $W_h'$.

$W_h'$, $W_h$, and $\Delta W_h$ may be obtained as follows. Coordinate values of a point group on the outer surface of the press-formed product 50 after the drawing and bending processing are acquired using a non-contact type CCD three-dimensional measurement apparatus. In the cross-sectional view when viewed from the arrow A direction in FIG. 6A, the gap $W_h'$ between the vertical wall portion 55*a*' and the vertical wall portion 55*b*' when the springback is generated is measured. The gap $W_h'$ is compared with the gap $W_h$ between the vertical wall portion 55*a* and the vertical wall portion 55*b* in CAD data (design shape) when the press-formed product 50 is designed. Accordingly, $\Delta W_h = W_h' - W_h$ is obtained.

Based on $\Delta W_h$ obtained in the above-described way, the wall warpage (springback) after the drawing and bending processing (press forming) was evaluated according to the following reference.

Good (G): $\Delta W_h$ is less than or equal to 10 mm

Not Bad (NB): $\Delta W_h$ is more than 10 mm and less than 15 mm

Bad (B): $\Delta W_h$ is equal to or more than 15 mm

Figure 19:
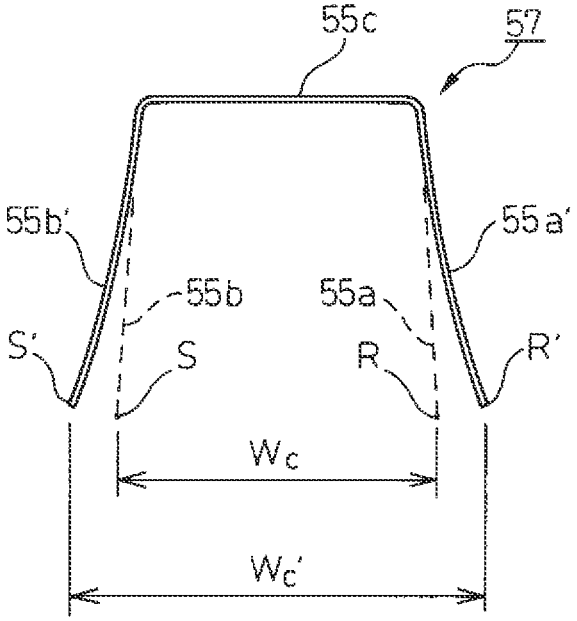
FIG. 19 is a vertical cross-sectional view perpendicular to the longitudinal direction of the press-formed product after the finishing processing (restriking processing), and an explanatory view showing the generation state of the wall warpage (springback).

FIG. 19 is a vertical cross-sectional view perpendicular to a longitudinal direction of the press-formed product after the finishing processing (restriking processing), and an explanatory view showing a generation state of wall warpage (springback). In FIG. 19, $W_c$ indicates the gap between the vertical wall portion 55*a* and the vertical wall portion 55*b* when the springback is not generated. $W_c'$ indicates the gap between the vertical wall portion 55*a*' and the vertical wall portion 55*b*' when the springback is generated. $\Delta W_c$ indicates the difference between $W_c'$ and $W_c$.

Specifically, as shown in FIG. 19, when an end of the vertical wall portion 55*a* is defined as a point R and an end of the vertical wall portion 55*b* is defined as a point S, the line segment RS becomes $W_c$. Moreover, when an end of the vertical wall portion 55*a*' is defined as a point R' and an end of the vertical wall portion 55*b*' is defined as a point S', the line segment R'S' becomes $W_c'$.

$W_c'$, $W_c$, and $\Delta W_c$ may be obtained as follows. Coordinate values of a point group on the outer surface of the press-formed product after the finishing processing (restriking processing) 57 are acquired using a non-contact type CCD three-dimensional measurement apparatus. In the cross-sectional view when viewed from the arrow B direction in FIG. 16A, the gap $W_c'$ between the vertical wall portion 55*a*' and the vertical wall portion 55*b*' when the springback is generated is measured. The gap $W_c'$ is compared with the gap $W_c$ between the vertical wall portion 55*a* and the vertical wall portion 55*b* in CAD data (design shape) when the press-formed product 57 is designed. Accordingly, $\Delta W_c = W_c' - W_c$ is obtained.

Based on $\Delta W_c$ obtained in the above-described way, the wall warpage (springback) after the finishing processing (restriking processing) was performed was evaluated according to the following reference.

Good (G): $\Delta W_c$ is less than or equal to 7 mm

Not Bad (NB): $\Delta W_c$ is more than 7 mm and less than 15 mm

Bad (B): $\Delta W_c$ is equal to or more than 15 mm

Figure 20:
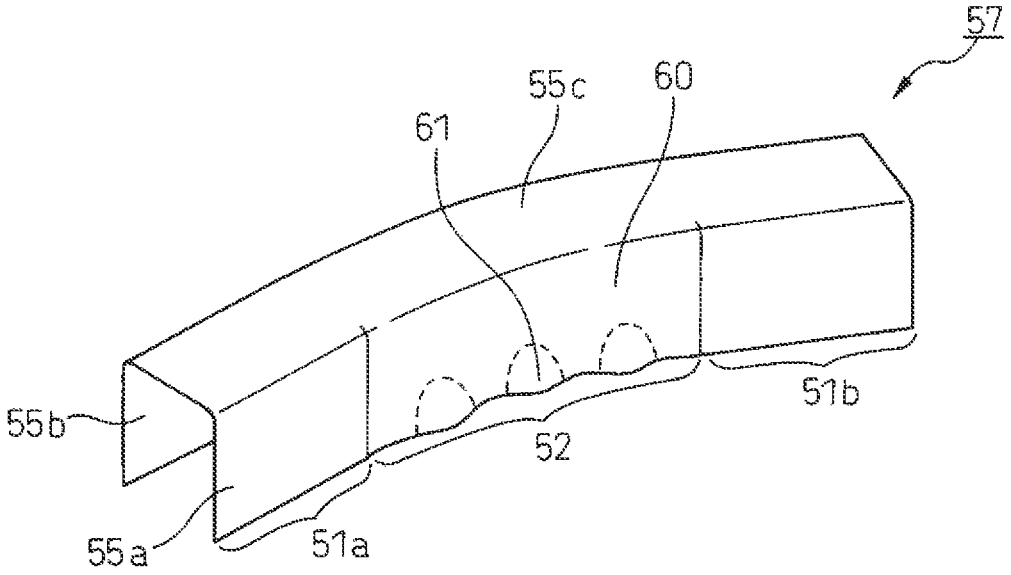
FIG. 20 is a perspective view showing the press-formed product after the finishing processing (restriking processing) and an explanatory view showing a generation state of waviness.

Moreover, FIG. 20 is a perspective view showing the press-formed product after the finishing processing (restriking processing) and an explanatory view showing a generation state of waviness (springback). In FIG. 20, a state where waviness 61 occurs on a curved face 60 of the bent portion 52 of the press-formed product 57 is shown.

Very Good (VG): $\Delta Y_w$ is less than or equal to 3 mm

Good (G): $\Delta Y_w$ is more than 3 mm and less than 7 mm

Not Bad (NB): $\Delta Y_w$ is more than 7 mm and less than 15 mm

Bad (B): $\Delta Y_w$ is equal to or more than 15 mm

Evaluation results of the springback with respect to the press-formed product 50 after the drawing and bending processing and the press-formed product 57 after the finishing processing (restriking processing) are shown in Table 2. After performing the drawing and bending processing and the restriking processing, cracks were not confirmed in the press-formed product 50 or the press-formed product 57 under any conditions.

TABLE 2

| | Crack | Springback | | | | | | |
|---|---|---|---|---|---|---|---|---|
| | | ΔWh | | ΔWc | | ΔYw | | |
| No. | Occurrence | (mm) | Evaluation | (mm) | Evaluation | (mm) | Evaluation | Remark |
| 1 | None | 16 | B | 13 | NB | 14 | NB | Reference Example |
| 2 | None | 13 | NB | 10 | NB | 8 | NB | Reference Example |
| 3 | None | 7 | G | 5 | G | 5 | G | Example |
| 4 | None | 6 | G | 4 | G | 4 | G | Example |
| 5 | None | 10 | G | 7 | G | 7 | G | Example |
| 6 | None | 9 | G | 7 | G | 7 | G | Example |
| 7 | None | 5 | G | 5 | G | 5 | G | Example |
| 8 | None | 10 | NB | 9 | NB | 8 | NB | Reference Example |
| 9 | None | 5 | G | 4 | G | 4 | G | Example |
| 10 | None | 5 | G | 3 | G | 3 | VG | Example |
| 11 | None | 8 | G | 6 | G | 5 | G | Example |
| 12 | None | 9 | G | 7 | G | 5 | G | Example |
| 13 | None | 18 | B | 14 | NB | 16 | B | Reference Example |
| 14 | None | 21 | B | 15 | B | 18 | B | Conventional Example |

Figure 21A:
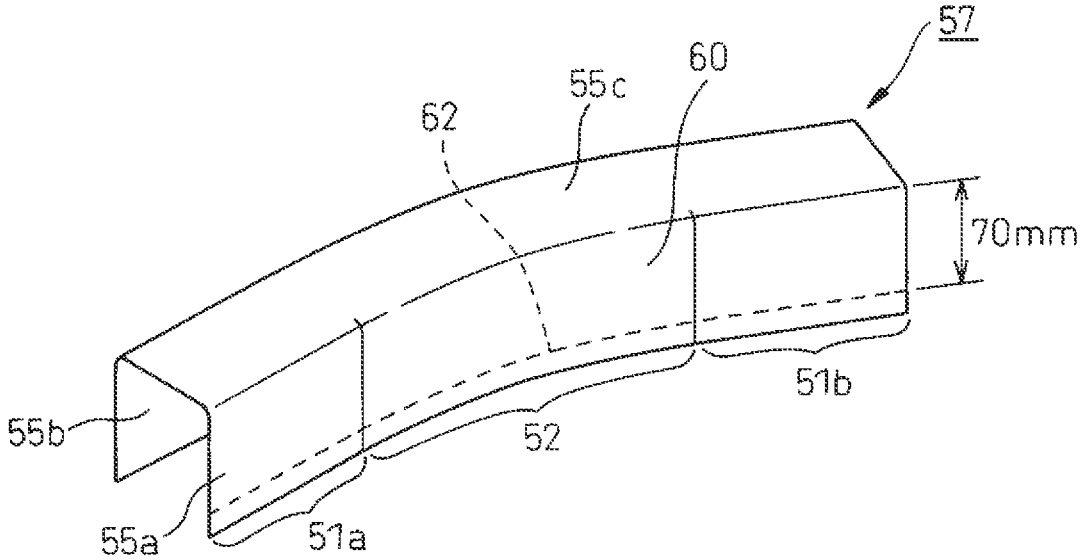
FIG. 21A is a perspective view showing the press-formed product after the finishing processing (restriking processing) and an explanatory view showing a measurement position of the waviness.

FIG. 21A is a perspective view showing the press-formed product after the finishing processing (restriking processing) and an explanatory view showing a measurement position of the waviness (springback). The generation state of the waviness 61 is evaluated at a line segment 62 shown by a dotted line in FIG. 21A.

Figure 21B:
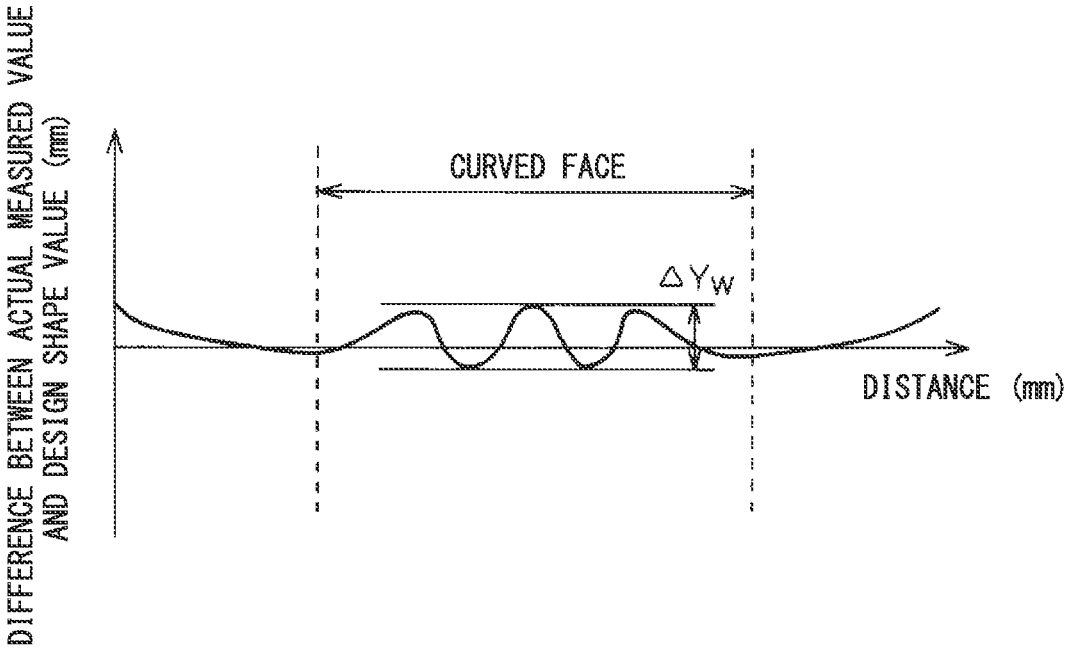
FIG. 21B is a graph showing an example of the measured result of the waviness in the press-formed product after the finishing processing (restriking processing).

FIG. 21B is a graph showing an example of the measured result of the waviness (springback). In FIG. 21B, a horizontal axis corresponds to the line segment 62 shown in FIG. 21A and a vertical axis indicates the generation state (a difference between an actual measured value and a design shape value) of the waviness 61.

The waviness 61 of the press-formed product 57 may be evaluated as follows. Coordinate values of a point group on the outer surface of the press-formed product after the finishing processing (restriking processing) 57 are acquired using a non-contact type CCD three-dimensional measurement apparatus. The measured results of the coordinate values in the line segment 62 in the curved face 60 are compared with the CAD data (design shape) when the press-formed product 57 is designed, and thus, the graph shown in FIG. 21B is prepared.

An absolute value $\Delta Y_W$ of the difference between the maximum value and the minimum value in the graph in the curved face 60 is obtained as shown in FIG. 21B. The line segment 62 which is the measurement position of the waviness 61 is parallel with an intersection line formed by the top portion 55*c* and the vertical wall portion 55*a* (having a U shaped cross-section) of the press-formed product 57, and the distance between the parallel lines is 70 mm.

Based on $\Delta Y_w$ obtained in this way, the waviness 61 (springback) after the finishing processing (restriking processing) was evaluated according to the following reference.

First, the evaluation result of the springback with respect to the press-formed product 50 after the drawing and bending processing is described. As shown in Table 2, in any one of the Examples No. 3 to No. 7 and No. 9 to No. 12 of the present invention, it was confirmed that $\Delta W_h$ after the drawing-bending processing was performed was good and the wall warpage (springback) was small.

On the other hand, in any one of Reference Examples No. 1, No. 2, No. 8, and No. 13, and Conventional Example No. 14, $\Delta W_h$, after the drawing and bending processing was performed was not better than $\Delta W_h$ of the Example of the present invention.

By comparing the Examples No. 3 and No. 6 of the present invention, when only the wrinkle suppression force increasing portions 16*a* and 16*b* were disposed, it was confirmed that the effect which is exerted by decreasing the springback was higher than when the wrinkle suppression force increasing portions 16*a* to 16*f* were disposed. That is to say, when only the wrinkle suppression force increasing portions 16*a* and 16*b* were disposed, the wrinkle suppression molds 25*a* and 25*b* were remarkably bent in the end phase of the press forming, compared to when the wrinkle suppression force increasing portions 16*c* to 16*f* are disposed.

As a result, it could be confirmed that the springback in the press-formed product 50 could be further decreased.

By comparing No. 1 to No. 4 in the Examples of the present invention and the Reference Examples, it could be confirmed that the thickness H and the thickness L preferably satisfy the above-described Expressions 1 and 2. In No. 1 to No. 4, only the thickness L of each of the wrinkle suppression molds 25*a* and 25*b* was changed, and other press-forming conditions were the same as one another.

In No. 1 to No. 4, the values of the protruding heights G were different from one another. However, above all, the position of the press stroke which is a starting position of increasing the wrinkle suppression force was 15% in these Examples, which was the same as one another.

Among No. 1 to No. 4, the thickness L exceeded 0.8×H in No. 1 and No. 2, and the thickness L was less than or equal to 0.8×H in No. 3 and No. 4. That is to say, in No. 3 and No. 4 which were examples satisfying Expression 1 or 2 in No. 1 to No. 4, the springback could be preferably decreased.

Here, FIGS. 22 to 25 show contact pressure distributions on the second surfaces 32*a* and 32*b* when the wrinkle suppression molds 25*a* and 25*b* receive the reaction force from the wrinkle suppression force increasing portions 16*a* and 16*b* in the end phase of the press forming.

Figure 22:
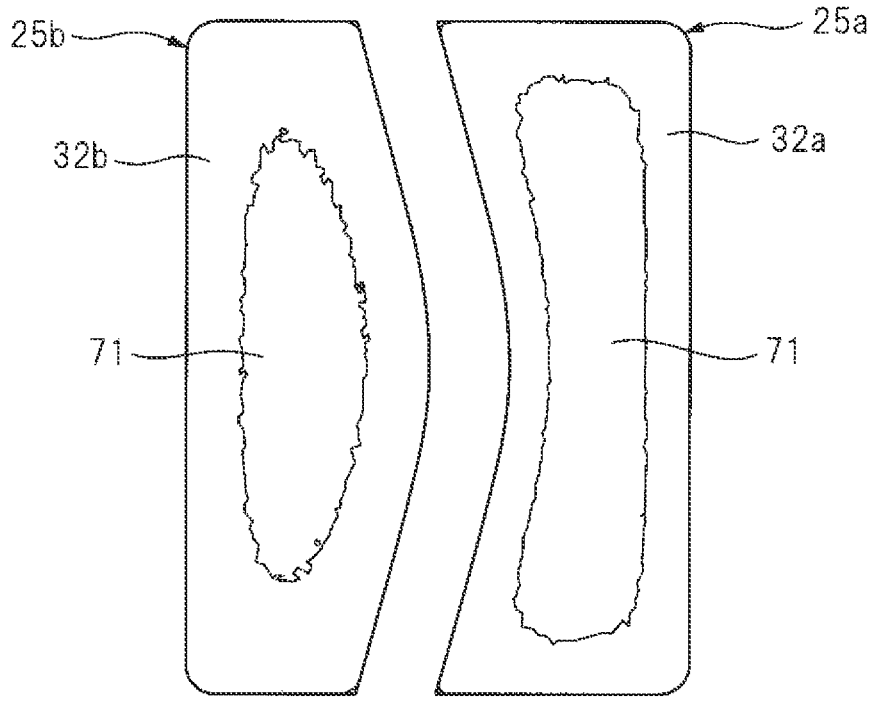
FIG. 22 is a view showing a contact pressure distribution on a second surface of the wrinkle suppression mold when a thickness ratio L/H of the wrinkle suppression mold is 100%.
Figure 23:
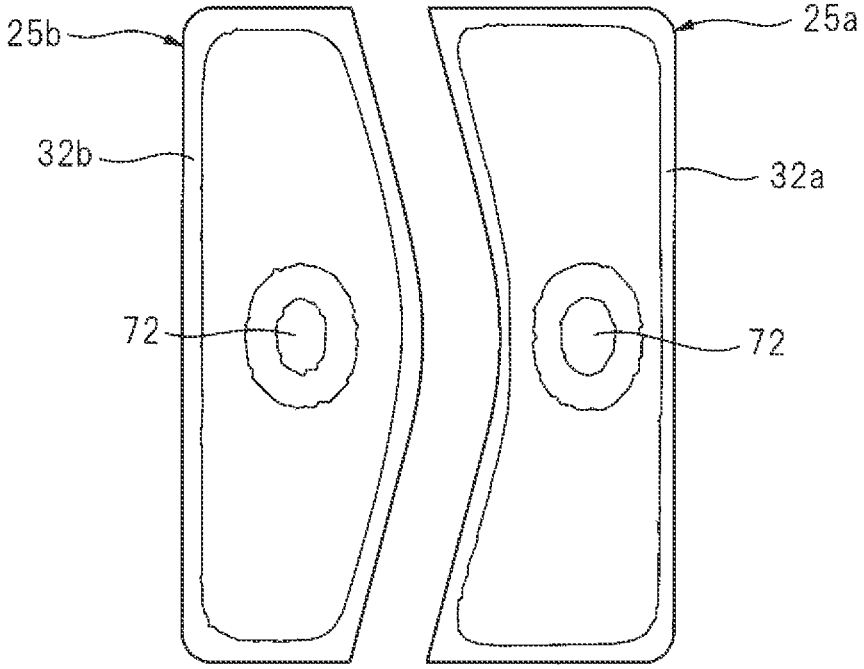
FIG. 23 is a view showing a contact pressure distribution on the second surface of the wrinkle suppression mold when the thickness ratio L/H of the wrinkle suppression mold is 90%.
Figure 24:
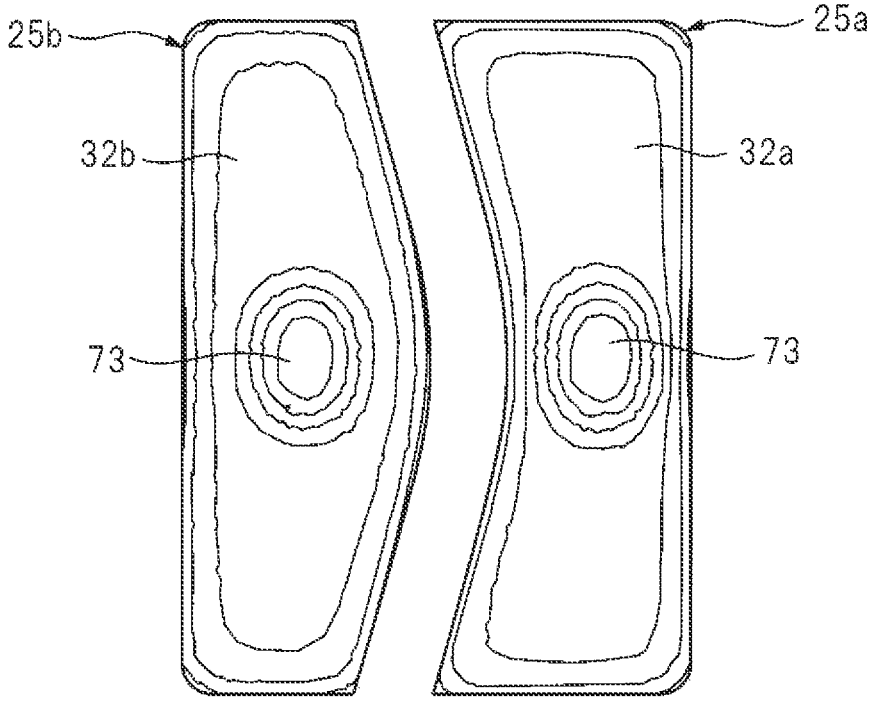
FIG. 24 is a view showing a contact pressure distribution on the second surface of the wrinkle suppression mold when the thickness ratio L/H of the wrinkle suppression mold is 80%.
Figure 25:
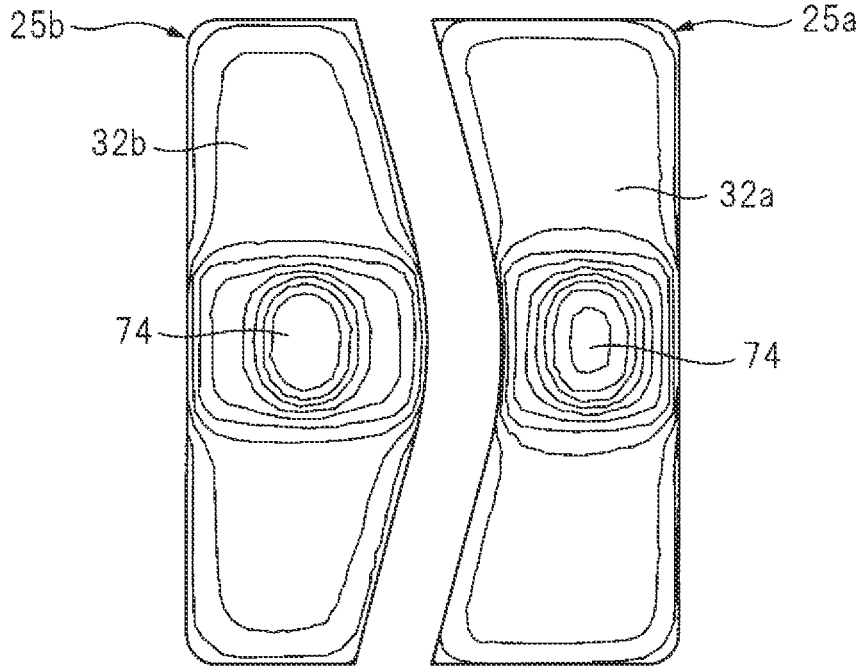
FIG. 25 is a view showing a contact pressure distribution on the second surface of the wrinkle suppression mold when the thickness ratio L/H of the wrinkle suppression mold is 70%.

FIGS. 22 to 25 correspond to No. 1 to No. 4 which are the Examples of the present invention and the Reference Examples. That is to say, FIG. 22 shows the contact pressure distribution on the second surface of the wrinkle suppression mold when the thickness ratio L/H of the wrinkle suppression mold is 100%. FIG. 23 shows the contact pressure distribution on the second surface of the wrinkle suppression mold when the thickness ratio L/H of the wrinkle suppression mold is 90%. FIG. 24 shows the contact pressure distribution on the second surface of the wrinkle suppression mold when the thickness ratio L/H of the wrinkle suppression mold is 80%. FIG. 25 shows the contact pressure distribution on the second surface of the wrinkle suppression mold when the thickness ratio L/H of the wrinkle suppression mold is 70%.

In FIGS. 22 to 25, reference numerals 71, 72, 73, and 74 indicate the regions in which the contact pressures on the second surfaces 32*a* and 32*b* become the maximum values. Moreover, in the regions of the reference numerals 71, 72, 73, and 74, the contact pressures were 1.5 MPa, 2.5 MPa, 6.5 MPa, and 8.7 MPa, respectively.

As shown in FIGS. 22 to 25, when the thickness H is 50 mm, the contact pressures on the regions corresponding to portions on which the pressure receiving portions 30*a* and 30*b* are provided on the second surfaces 32*a* and 32*b* of the wrinkle suppression molds 25*a* and 25*b* are increased as the thickness ratio L/H is decreased. As described above, the flange portions 54*a* and 54*b* of the press-formed product 50 is held between the die 20 and the second surfaces 32*a* and 32*b* of the wrinkle suppression molds 25*a* and 25*b*, and the wrinkle suppression force is applied to the flange portions.

Accordingly, the portion which is particularly added the increased wrinkle suppression force on the flange portions 54*a* and 54*b* and a portion of the region (the region on which the pressure receiving portions 30*a* and 30*b* are provided) in which the contact pressure is preferably increased on the second surfaces 32*a* and 32*b* overlap with each other when viewed along the pressing direction.

By comparing No. 4, No. 11 to No. 13 which are the Examples of the present invention and the Reference Examples, it could be confirmed that the protruding height G of each of the wrinkle suppression force increasing portions 16*a* and 16*b* preferably satisfy the above-described Expression 3. In No. 4, No. 11 to No. 13, only the position of the press stroke which is a starting position of increasing the wrinkle suppression force is changed by changing the value of the protruding height G, and other press forming conditions are the same as one other.

Among No. 4, No. 11 to No. 13, in No. 11, the position of the press stroke which is a starting position of increasing the wrinkle suppression force is 33%. In No. 13, the position of the press stroke which is a starting position of increasing the wrinkle suppression force is 1.8%.

On the other hand, among No. 4, No. 11 to No. 13, in No. 4, the position of the press stroke which is a starting position of increasing the wrinkle suppression force is 15%. In No. 12, the position of the press stroke which is a starting position of increasing the wrinkle suppression force is 2.5%.

That is to say, among No. 4, No. 11 to No. 13, the protruding height G satisfies Expression 3 in No. 4 and No. 12. In this way, in No. 4 and No. 12 which are the examples satisfying Expression 3 among No. 4, No. 11 to No. 13, it could be confirmed that the springback could be preferably decreased.

On the other hand, as described above, in Reference Example No. 1 and No. 2, since the thickness L exceeded 0.8×H, the springback could not be decreased. In Reference Example No. 8, since the thickness L exceeded 40 mm, the springback could not be decreased.

As described above, in Reference Example No. 13, since the position of the press stroke which is a starting position of increasing the wrinkle suppression force was 1.8% and the increase of the wrinkle suppression force in the end phase of the press forming was not sufficient, the springback could not be decreased. In Conventional Example No. 14, since the pressure receiving portions 30*a* and 30*b* and the wrinkle suppression force increasing portions 16*a* and 16*b* were not provided, the springback could not be decreased.

Next, the evaluation method of the springback with respect to the press-formed product after the finishing processing (restriking processing) 57 will be described. As shown in Table 2, in any one of the Examples No. 3 to No. 7 of the present invention, it could be confirmed that No. 9 to No. 12, $\Delta W_c$ and $\Delta Y_w$ after the finishing processing (restriking processing) were good and the wall warpage and the waviness 61 were small.

It could be confirmed that the dimension accuracy of the press-formed product after the finishing processing (restriking processing) 57 was improved as the springback of the press-formed product after the drawing and bending processing 50 was decreased. This is because the tensile stress in the longitudinal direction of the press-formed product 50 on the vertical wall surfaces 55*a* and 55*b* of the bent portion 52 is decreased by increasing the wrinkle suppression force of the bent portion 52 in the end phase of the press forming in the drawing and bending processing.

As a result, the non-uniformity of the residual stress in the plate thickness direction or the in-plane direction of the press-formed product 50 is decreased, and thus, the dimension accuracy of the press-formed product after the finishing processing (restriking processing) 57 is also improved.

On the other hand, in any one of Reference Examples No. 1, No. 2, No, 8, and No. 13 and Conventional Example No. 14, $\Delta W_c$ and $\Delta Y_w$ after the restriking processing were not better than $\Delta W_c$ and $\Delta Y_w$ of the Example of the present invention. In this way, if the springback of the press-formed product after the drawing and bending processing 50 was large, even when the finishing processing (restriking processing) was performed, it could be confirmed that the dimension accuracy of the press-formed product 57 was not improved.

EXAMPLE 2

Figure 26:
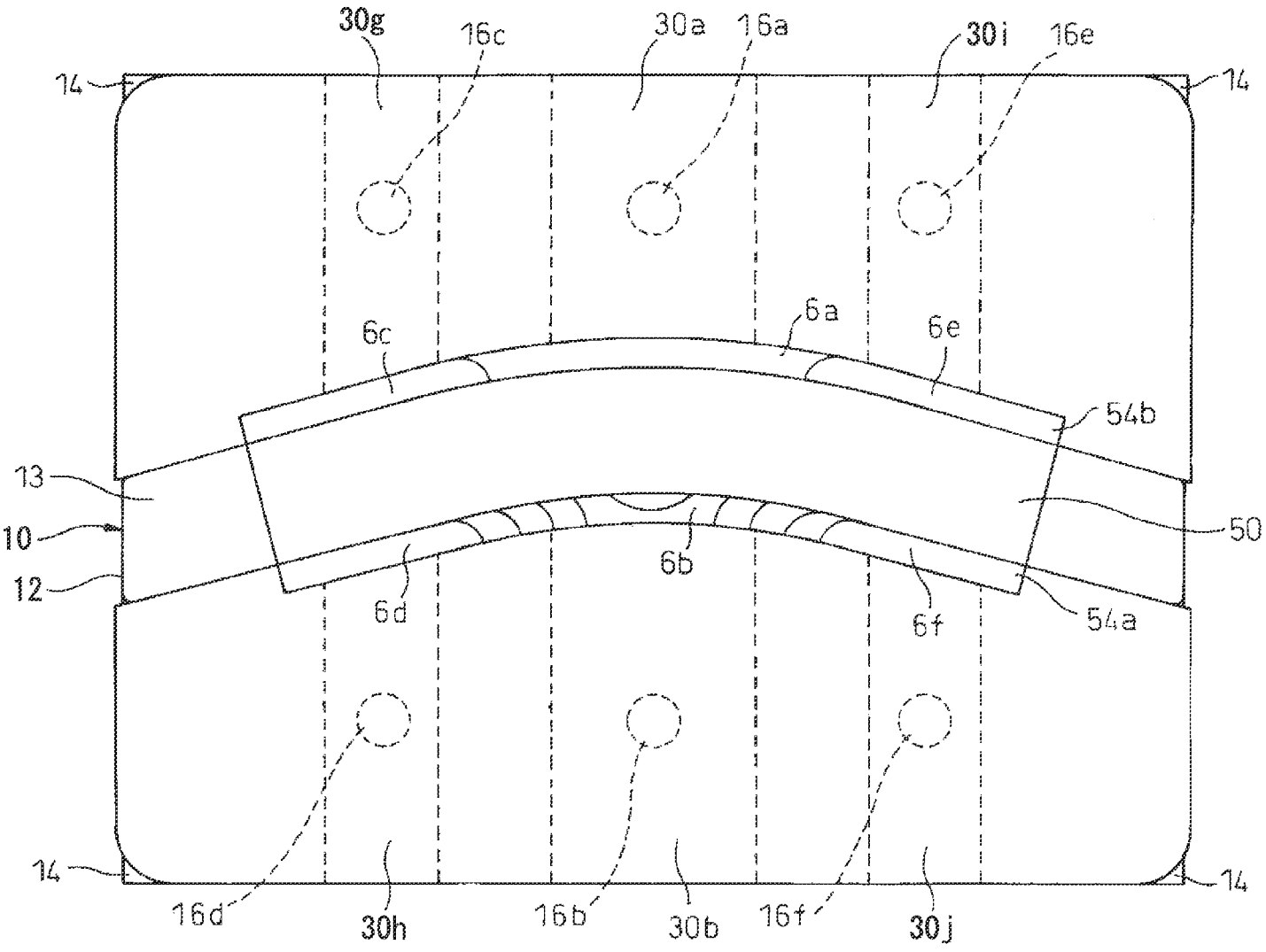
FIG. 26 is a view showing disposed positions of the pressure receiving portion and the wrinkle suppression force increasing portion of the press-forming tool.

FIG. 26 is a view showing disposed positions of the pressure receiving portion and the wrinkle suppression force increasing portion of the press-forming tool. As shown in FIG. 26, the disposition positions of the pressure receiving portions 30*a*, 30*b*, and 30*g* to 30*j* and the wrinkle suppression force increasing portions 16*a* to 16*f* were changed, and the blank material 5 was performed the drawing and bending processing (press forming).

Specifically, a high tensile strength steel sheet having 1.0 mm in the plate thickness and 590 MPa in the tensile strength was used as the material, and similar to the Example 1, the high tensile strength steel sheet was laser-cut, and thus, the blank material 5 was obtained. The blank material 5 was performed the drawing and bending processing (press forming) to have the shape (hat-shaped cross section) shown in FIGS. 6A and 6B.

The load (reaction force) applied to the wrinkle suppression molds 25*a* and 25*b* by the disc spring unit of the wrinkle suppression force increasing portions 16*a* to 16*f* was set to 150 kN. Moreover, the protruding height G was set to 19 mm. The press stroke distance PS from the press-forming starting point to the press-forming ending point was set to 60 mm. That is to say, when the forming start position of the press stroke was set to 100% and the forming end position of the press stroke was set to 0% during the press-forming of the blank material 5, the position of the press stroke which is a starting position of increasing the wrinkle suppression force was set to 6.7%.

After the drawing and bending processing, the finishing processing (restriking processing) was performed. The conditions of the drawing and bending processing, the conditions of the restriking processing, and the evaluation method of the springback were similar to those of the Example 1.

TABLE 3

| No. | Reference figure | Pressure receiving portion | Wrinkle suppression force increasing portion Position | Wrinkle suppression force increasing portion Load (kN) | Protrusion height G (mm) | Thickness H (mm) | Thickness L (mm) | L/H (%) | Press Stroke Position which is added increased wrinkle suppression force (%) | Remark |
|---|---|---|---|---|---|---|---|---|---|---|
| 15 | FIG. 26 | 30a | 16a | 150 (150 × 1) | 19 | 50 | 35 | 70 | 6.7 | Reference Example |
| 16 | FIG. 26 | 30b | 16b | 150 (150 × 1) | 19 | 50 | 35 | 70 | 6.7 | Example |
| 17 | FIG. 26 | 30g | 16c | 150 (150 × 1) | 19 | 50 | 35 | 70 | 6.7 | Reference Example |
| 18 | FIG. 26 | 30h | 16d | 150 (150 × 1) | 19 | 50 | 35 | 70 | 6.7 | Reference Example |
| 19 | FIG. 26 | 30i | 16e | 150 (150 × 1) | 19 | 50 | 35 | 70 | 6.7 | Reference Example |
| 20 | FIG. 26 | 30j | 16f | 150 (150 × 1) | 19 | 50 | 35 | 70 | 6.7 | Reference Example |

Table 3 shows combinations of the disposed positions of the pressure receiving portions 30*a*, 30*b*, and 30*g* to 30*j* and the wrinkle suppression force increasing portions 16*a* to 16*f*. For example, the press-forming tool of Example No. 16 of the present invention is the same as the press-forming tool 2 of Example No. 5 of the present invention of the Example 1 except for the thickness H, the thickness L, and the thickness ratio L/H.

The evaluation results of the springback with respect to the press-formed product after the drawing and bending processing 50 and the press-formed product after the finishing processing (restriking processing) 57 are shown in Table 4. After the drawing and bending processing and the restriking processing were performed, in any condition, cracks were not confirmed in the press-formed product 50 or the press-formed product 57.

TABLE 4

| No. | Crack Occurrence | Springback ΔWh (mm) | ΔWh Evaluation | ΔWc (mm) | ΔWc Evaluation | ΔYw (mm) | ΔYw Evaluation | Remark |
|---|---|---|---|---|---|---|---|---|
| 15 | None | 12 | NB | 10 | NB | 10 | NB | Reference Example |
| 16 | None | 7 | G | 6 | G | 6 | G | Example |
| 17 | None | 18 | B | 14 | NB | 15 | B | Reference Example |
| 18 | None | 15 | B | 12 | NB | 13 | NB | Reference Example |

TABLE 4-continued

| | Crack | Springback | | | | | | |
|---|---|---|---|---|---|---|---|---|
| | | ΔWh | | ΔWc | | ΔYw | | |
| No. | Occurrence | (mm) | Evaluation | (mm) | Evaluation | (mm) | Evaluation | Remark |
| 19 | None | 19 | B | 14 | NB | 15 | B | Reference Example |
| 20 | None | 15 | B | 12 | NB | 14 | NB | Reference Example |

As shown in Table 4, in Example No. 16 of the present invention, $\Delta W_h$ after the drawing and bending processing, and $\Delta W_c$ and $\Delta Y_w$ after the finishing processing were good, and it could be confirmed that the springback was small.

In Example No. 16 of the present invention, the pressure receiving portion 30*b* was disposed so that the pressure receiving portion overlapped with a portion of the curved inside portion 6*b* which becomes the plate thickness decreasing portion having the plate thickness more than 0% and less than or equal to 97% with respect to the curved outside portion 6*a* which becomes the plate thickness maximum portion on the flange portion 54*a* and 54*b* of the press-formed product 50 press-formed by the press-forming tool 91 of the related art.

That is to say, in Example No. 16 of the present invention, the wrinkle suppression force could be locally and intensively increased to the curved inside portion 6*b* which is necessary to increase the wrinkle suppression force in the end phase of the press forming, which was difficult to be achieved by the press-forming tool 91 of the related art.

On the other hand, in any one of Reference Example No. 15 and No. 17 to No. 20, $\Delta W_h$, $\Delta W_c$, and $\Delta Y_w$ were not better than Example No. 16 of the present invention. As shown in Table 4, in Reference Example No. 15 and No. 17 to No. 20, the pressure receiving portions 30*a* and 30*g* to 30*j* were disposed so that the pressure receiving portions overlapped with not the curved inside portion 6*b* which becomes the plate thickness decreasing portion but at least a portion of the curved outside portion 6*a* or the straight line portions 6*c* to 6*f*.

Accordingly, the wrinkle suppression force could not be increased to the curved inside portion 6*b* which is necessary to increase the wrinkle suppression force in the end phase of the press forming. In general, in the press-formed product 57, it is required that the dimensions on the entire region of the press-formed product 57 are within a permitted range.

That is to say, the press-formed product 57 in which the dimensions are outside the permitted range even at one site, for example, the press-formed products 57 of the Reference Examples No. 15 and Nos. 17 to 20 are not preferable.

As described above, if the wrinkle suppression force on the plate thickness decreasing portion which is necessary to increase the wrinkle suppression force was increased in the end phase of the press forming, it could be confirmed that the dimension accuracy of the press-formed product after the drawing and bending processing 50 and the press-formed product after the finishing processing (restriking processing) 57 could be preferably improved.

INDUSTRIAL APPLICABILITY

As described above, according to an aspect of the present invention, a pressure receiving portion is provided on a portion of a wrinkle suppression mold, and a wrinkle suppression force increasing portion is provided on a portion of a punch. The pressure receiving portion and the wrinkle suppression force increasing portion come into contact with each other in the end phase of the press forming, and thus, the wrinkle suppression mold is elastically deformed.

As a result, the wrinkle suppression force generated from the wrinkle suppression force increasing portion is sufficiently transmitted to the portion of a blank material which is added the increased wrinkle suppression force in the end phase of press forming.

That is to say, even when the press-formed product includes an extension flange deformation region in addition to a shrinkage flange deformation region, springback of the press-formed product can be effectively decreased. Accordingly, the industrial applicability thereof is high.

BRIEF DESCRIPTION OF THE REFERENCE SYMBOLS

1 to 4: press-forming tool
5: blank material
6*a*: curved outside portion (plate thickness maximum portion)
6*b*: curved inside portion (plate thickness decreasing portion)
6*c* to 6*f*: straight line portion
10: punch
12: punch portion
14: plate portion
16*a* to 16*f*: wrinkle suppression force increasing portion (disc spring unit)
20: die
25*a* to 25*f*: wrinkle suppression mold
30*a*, 30*b*, and 30*g* to 30*j*: pressure receiving portion (groove portion)
30*c* and 30*d*: pressure receiving portion
31*a* to 31*f*: first surface
32*a* to 32*f*: second surface
33*a* and 33*b*: third surface (side surface)
35*c* and 35*d*: groove portion
40*a*: pin
42*a*: disc spring (elastic body)
50: press-formed product after drawing and bending processing
51*a* and 51*b*: straight side portion
52: bent portion
54*a*, 54*a*', 54*b*, and 54*b*': flange portion
55*a*, 55*a*', 55*b*, and 55*b*': vertical wall portion
55*c*: top portion
57: press-formed product after the finishing processing (restriking processing)
60: curved face
61: waviness
62: line segment
G: protruding height
H and L: thickness
PS: press stroke distance

The invention claimed is:

1. A press-forming tool comprising:

a punch which includes a punch portion and a plate portion which are configured to transfer a shape to a blank material;

a die which is paired with the punch and which opposes the punch portion;

a wrinkle suppression mold which includes a first surface which opposes the plate portion and which comes into contact with the plate portion at a press-forming ending point, a second surface which opposes the die and which holds the blank material along with the die, and a third surface which is continuous between the first surface and the second surface and which opposes the punch portion via a gap;

a pressure receiving portion which includes a groove portion and which is disposed on the first surface of the wrinkle suppression mold, the groove portion having a depth greater than zero with respect to the first surface of the wrinkle suppression mold; and a wrinkle suppression force increasing portion which is disposed on the plate portion so as to oppose the first surface, which protrudes toward the pressure receiving portion, which does not contact the groove portion of the pressure-receiving portion at a press-forming starting point, and which generates a reaction force in a direction opposite to a pressing direction when being pressed in the pressing direction in an end phase of a press forming.

2. The press-forming tool according to claim 1, wherein when a region in which a plate thickness is maximum in a flange portion of a press-formed product is defined as a plate thickness maximum portion and a region in which the plate thickness is more than 0% and less than or equal to 97% with respect to the plate thickness maximum portion is defined as a plate thickness decreasing portion, based on a case where the pressure receiving portion and the wrinkle suppression force increasing portion are removed from the press-forming tool, the pressure receiving portion overlaps with a portion of a region corresponding to the plate thickness decreasing portion in the blank material when viewed along the pressing direction.

3. The press-forming tool according to claim 1, wherein the pressure receiving portion is consisted of the groove portion, when a thickness of the wrinkle suppression mold in a position of the groove portion is defined as L in mm units and a minimum value of the thickness of the wrinkle suppression mold in a position which excludes the groove portion and comes into contact with the blank material is defined as H in mm units, the wrinkle suppression mold satisfies a following Expression 1 or 2, and when a protruding height of the wrinkle suppression force increasing portion is defined as G in mm units and a press stroke distance from the press-forming starting point to the press-forming ending point is defined as PS in mm units, and the protruding height G of the wrinkle suppression force increasing portion satisfies a following Expression 3:

$$20 \le L \le 0.8 \times H \text{ when } 40 \le H \le 50 \quad \text{(Expression 1)}$$

$$20 \le L \le 40 \text{ when } 50 < H \le 80 \quad \text{(Expression 2)}$$

$$0.02 \times PS + H - L \le G \le 0.3 \times PS + H - L \quad \text{(Expression 3).}$$

4. The press-forming tool according to claim 1, wherein a portion of a boundary which partitions the pressure receiving portion is the groove portion.

5. The press-forming tool according to claim 1, wherein the wrinkle suppression force increasing portion includes an elastic body which applies the reaction force.

6. The press-forming tool according to claim 5, wherein the elastic body is at least one of a disc spring, a helical spring, and a rubber.

7. A method for manufacturing a press-formed product which is press-formed using the press-forming tool according to claim 1, comprising:

press-forming a blank material by increasing a wrinkle suppression force with respect to a portion of the blank material in an end phase of a press forming, which is started at a position at which a press stroke is 2% to 30% and which is ended at a forming end position, when a forming start position of the press stroke is defined as 100% and the forming end position of the press stroke is defined as 0% during the press forming of the blank material.

8. The press-forming tool according to claim 2, wherein the pressure receiving portion is consisted of the groove portion, when a thickness of the wrinkle suppression mold in a position of the groove portion is defined as L in mm units and a minimum value of the thickness of the wrinkle suppression mold in a position which excludes the groove portion and comes into contact with the blank material is defined as H in mm units, the wrinkle suppression mold satisfies a following Expression 1 or 2, and when a protruding height of the wrinkle suppression force increasing portion is defined as G in mm units and a press stroke distance from the press-forming starting point to the press-forming ending point is defined as PS in mm units, and the protruding height G of the wrinkle suppression force increasing portion satisfies a following Expression 3:

$$20 \le L \le 0.8 \times H \text{ when } 40 \le H \le 50 \quad \text{(Expression 1)}$$

$$20 \le L \le 40 \text{ when } 50 < H \le 80 \quad \text{(Expression 2)}$$

$$0.02 \times PS + H - L \le G \le 0.3 \times PS + H - L \quad \text{(Expression 3).}$$

9. The press-forming tool according to claim 2, wherein a portion of a boundary which partitions the pressure receiving portion is the groove portion.

10. The press-forming tool according to claim 2, wherein the wrinkle suppression force increasing portion includes an elastic body which applies the reaction force.

11. The press-forming tool according to claim 10, wherein the elastic body is at least one of a disc spring, a helical spring, and a rubber.

12. A method for manufacturing a press-formed product which is press-formed using the press-forming tool according to claim 2, comprising:

press-forming a blank material by increasing a wrinkle suppression force with respect to a portion of the blank material in an end phase of a press forming, which is started at a position at which a press stroke is 2% to 30% and which is ended at a forming end position, when a forming start position of the press stroke is defined as 100% and the forming end position of the press stroke is defined as 0% during the press forming of the blank material.

* * * * *